United States Patent [19]

Kushigian

[11] Patent Number: 4,484,931

[45] Date of Patent: Nov. 27, 1984

[54] THREAD GRINDER

[76] Inventor: Anthony Kushigian, P.O. Box 768, Hendersonville, N.C. 28739

[21] Appl. No.: 487,281

[22] Filed: Apr. 21, 1983

Related U.S. Application Data

[62] Division of Ser. No. 222,501, Jan. 5, 1981, Pat. No. 4,393,624.

[51] Int. Cl.[3] ..... B24B 3/22

[52] U.S. Cl. ..... 51/95 TG; 51/48 HE

[58] Field of Search ..... 51/5 R, 5 D, 95 TG, 51/95 LH, 95 R, 48 HE, 165.87, 165.79, 288; 10/89 R, 129 R

[56] References Cited

U.S. PATENT DOCUMENTS

| | | | |
|---|---|---|---|
| 3,337,996 | 8/1967 | Stade et al. | 51/95 TG |
| 3,538,647 | 11/1970 | Woloszyn | 51/95 TG |
| 3,905,156 | 9/1975 | Vogelsanger | 51/48 HE |
| 4,142,330 | 3/1979 | Thut | 51/95 TG |
| 4,182,083 | 1/1980 | Kushigian | 51/165.79 |
| 4,358,911 | 11/1982 | Vogelsanger | 51/95 TG |

FOREIGN PATENT DOCUMENTS 158511 10/1963 U.S.S.R. ..... 51/5 D

*Primary Examiner*—Frederick R. Schmidt
*Assistant Examiner*—Robert A. Rose
*Attorney, Agent, or Firm*—Barnes, Kisselle, Raisch, Choate, Whittemore & Hulbert

[57] ABSTRACT

A machine for grinding threads on a workpiece which is rotated in a workhead while the workhead is reciprocated by a table under a grinding wheel to form threads in the workpiece. To improve the accuracy with which the threads are formed, the workpiece and a grinding wheel dresser contact the grinding wheel on the same side of the wheel at points which are symmetrical to and on opposite sides of the centerline of the wheel which extends parallel to the path along which the wheel is fed into the workpiece. If a fluted workpiece is being ground to produce a tap, the threads may be relieved in accordance with either the United States or European convention.

10 Claims, 27 Drawing Figures

146
46
122
5
12
304
110
120
118
112
290
30
12
228
226
88
309
44
48
90
230
250
91
86
240
248
224
252
58
5
254
432
440
60
68
50
438
64
66

122
46
112
110
30
50
4
4
52
54
62
56

THREAD GRINDER

This is a divisional of application Ser. No. 222,501, filed on Jan. 5, 1981, now U.S. Pat. No. 4,393,624.

This invention relates to the grinding of threads and more particularly to a machine for grinding threads on a workpiece such as the cutting threads of a tap for forming internal threads.

Conventional taps usually have a shank with cutting threads extending about a portion of the periphery thereof and flutes extending through the threads to form cutting edges. Such taps usually have two, three, or four flutes which may be either straight, helical, or spiral. The cutting threads must be formed with extreme accuracy.

The cutting threads are dimensioned in accordance with either the English or metric system and are either nonrelieved or relieved. Cutting threads may be relieved in accordance with either the United States or European convention. Under the European convention, the threads are relieved to the start of the cutting edge while under the United States convention, the threads are relieved behind the start of the cutting edge.

Cutting threads have been formed on taps by previously known grinding machines. Typically, but not necessarily, the threads are ground on workpieces of hardened steel in which the flutes have already been machined. Forming the cutting threads on the workpieces by grinding requires multiple passes or in-feeds of a grinding wheel to produce a finished thread. Prior machines for grinding relieved threads have used a different cam size with an arcemedian spiral to produce relieved threads on taps of a different diameter and, hence, required considerable set-up time and an expensive cam for each different diameter tap to be produced.

Objects, features, and advantages of this invention are to provide a thread grinding machine which can produce both English and metric threads, can produce both relieved and non-relieved threads, can produce relieved threads in accordance with both the United States and European conventions, can produce threads for taps having two, three, and four flutes, and compared to previously known thread grinding machines, has substantially improved accuracy, significantly increased output, is substantially less expensive, and requires substantially less time to set up.

These and other objects, features, and advantages of this invention will be apparent from the following detailed description, appended claims, and accompanying drawings in which:

Figure 9:
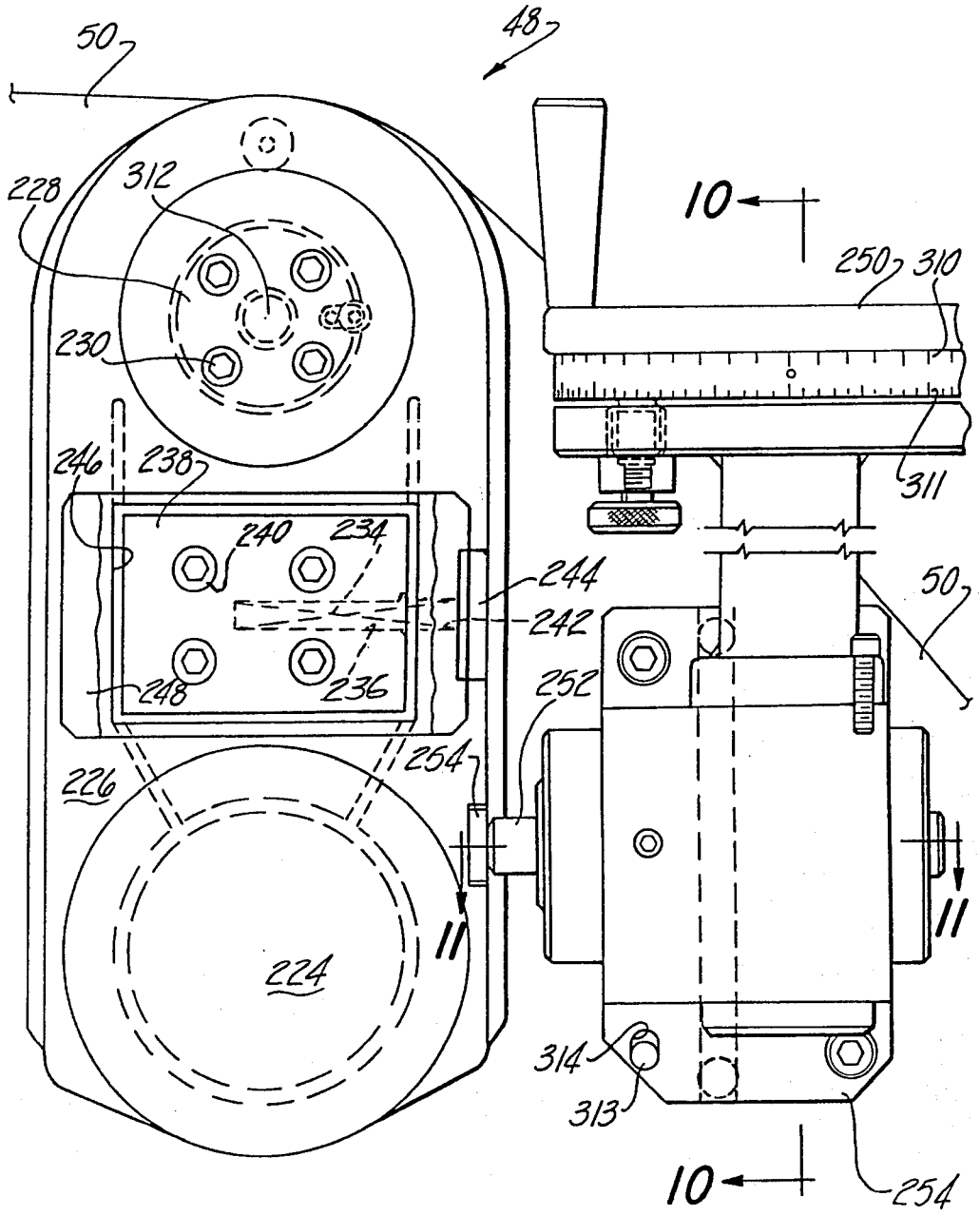
FIG. 9 is an enlarged fragmentary end view of the dresser assembly of the grinding machine of FIG. 1.
Figure 10:
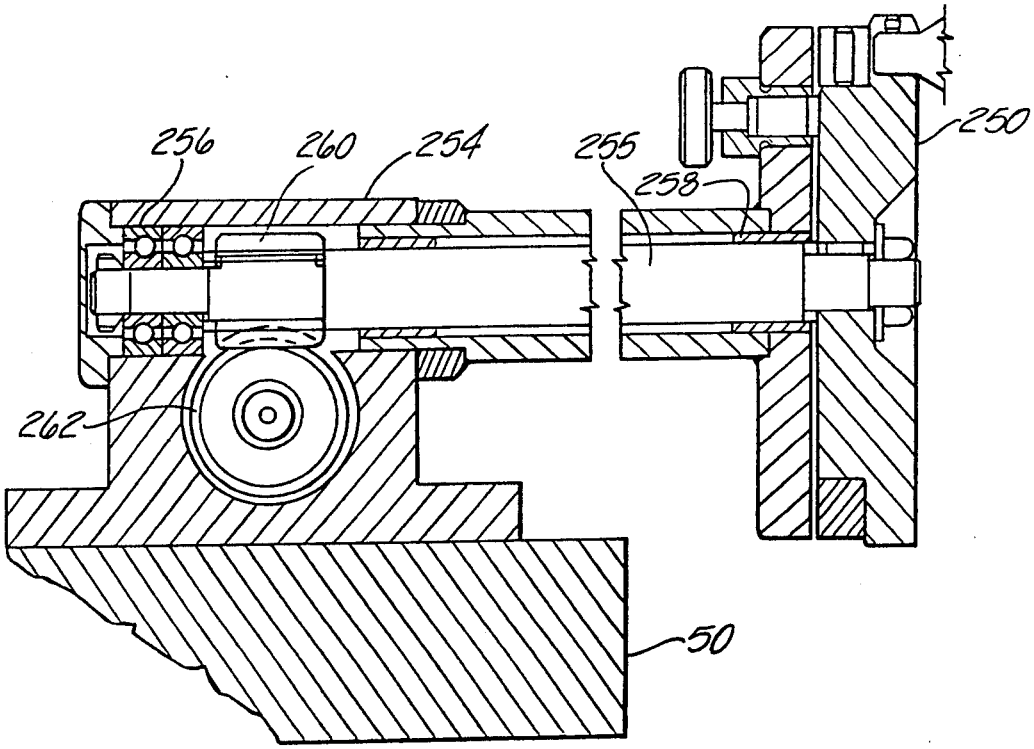
Figure 11:
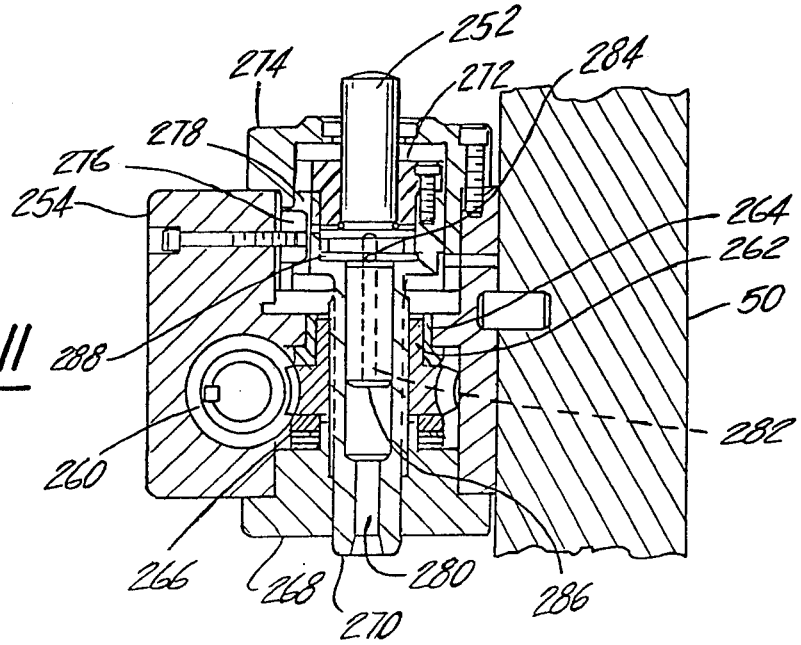

FIGS. 10 and 11 are fragmentary sectional views on lines 10—10 and 11—11 respectively of FIG. 9.

Figure 2:
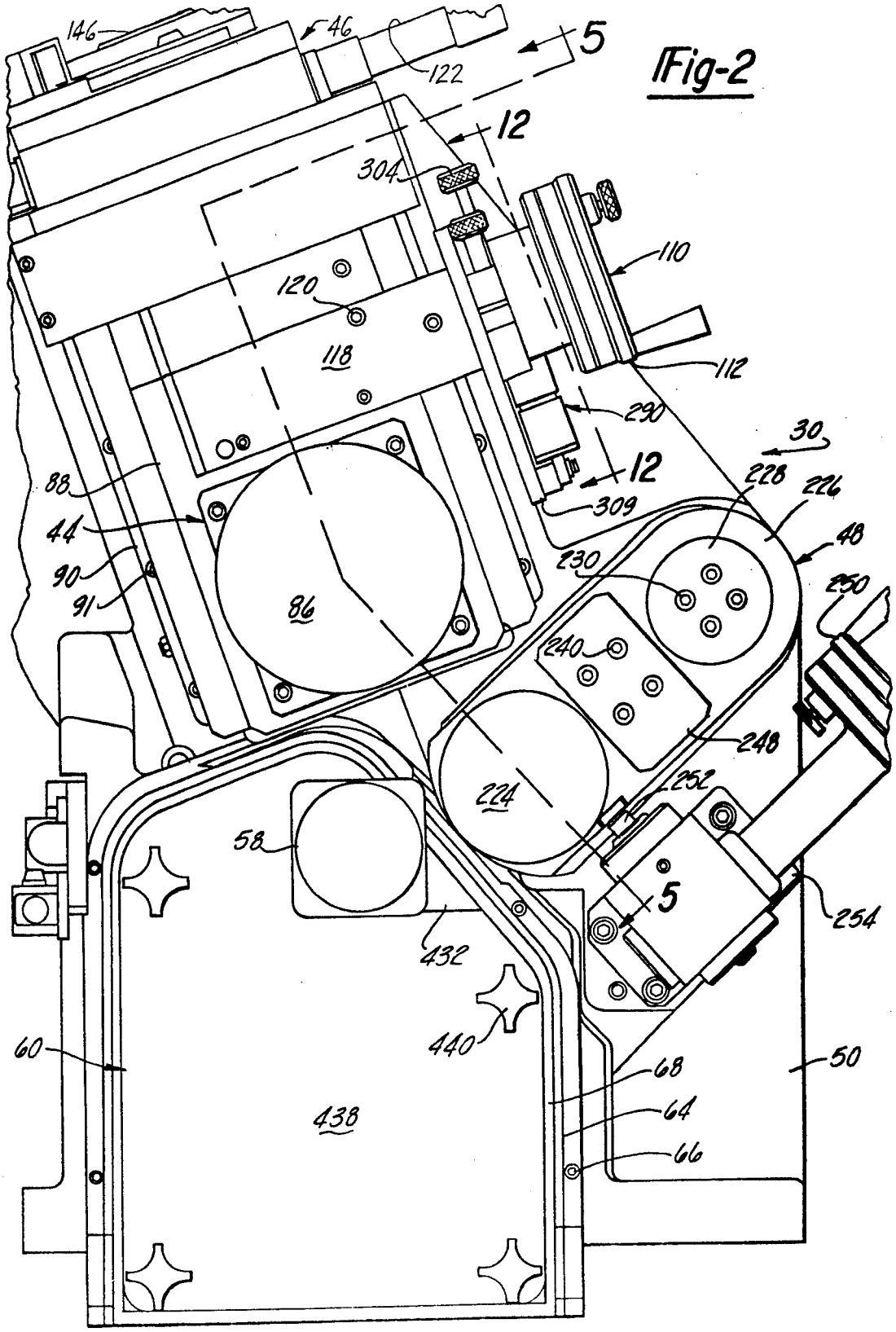
FIG. 2 is a fragmentary view of one end of the grinding machine of FIG. 1.
Figure 12:
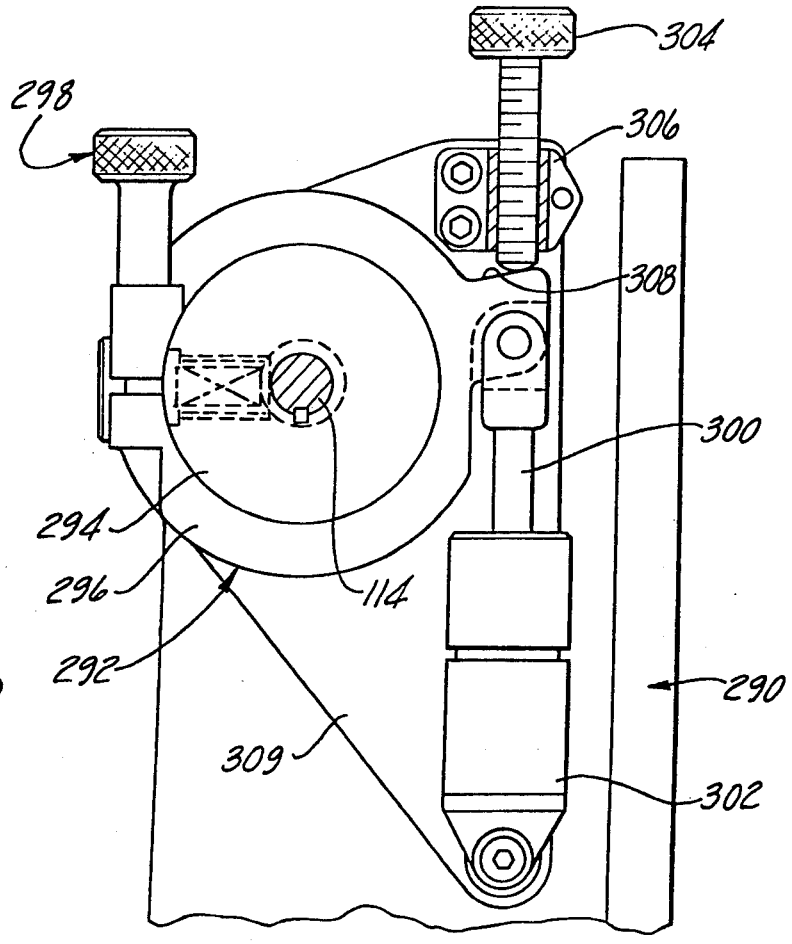

FIG. 12 is a fragmentary sectional view on line 12—12 of FIG. 2.

Figure 13:
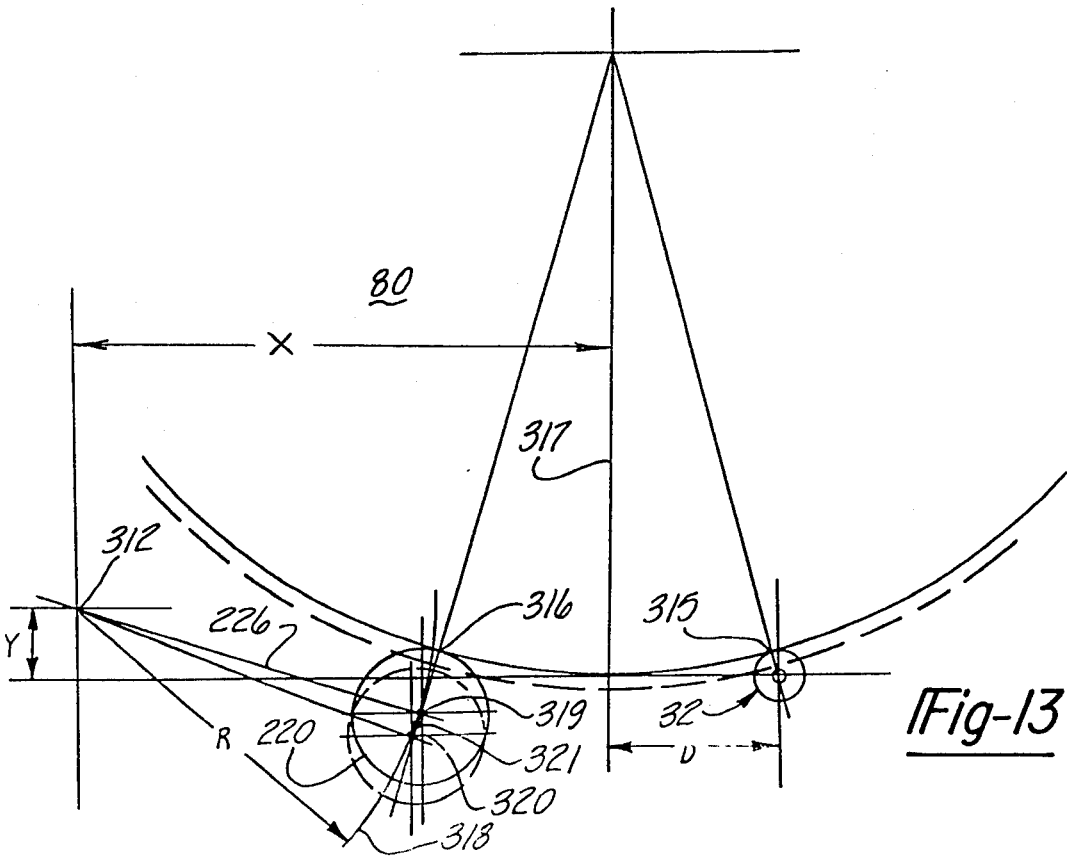

FIG. 13 is a schematic of the geometric relationship between the grinding wheel, grinding wheel dresser, and workpiece.

Figure 1:
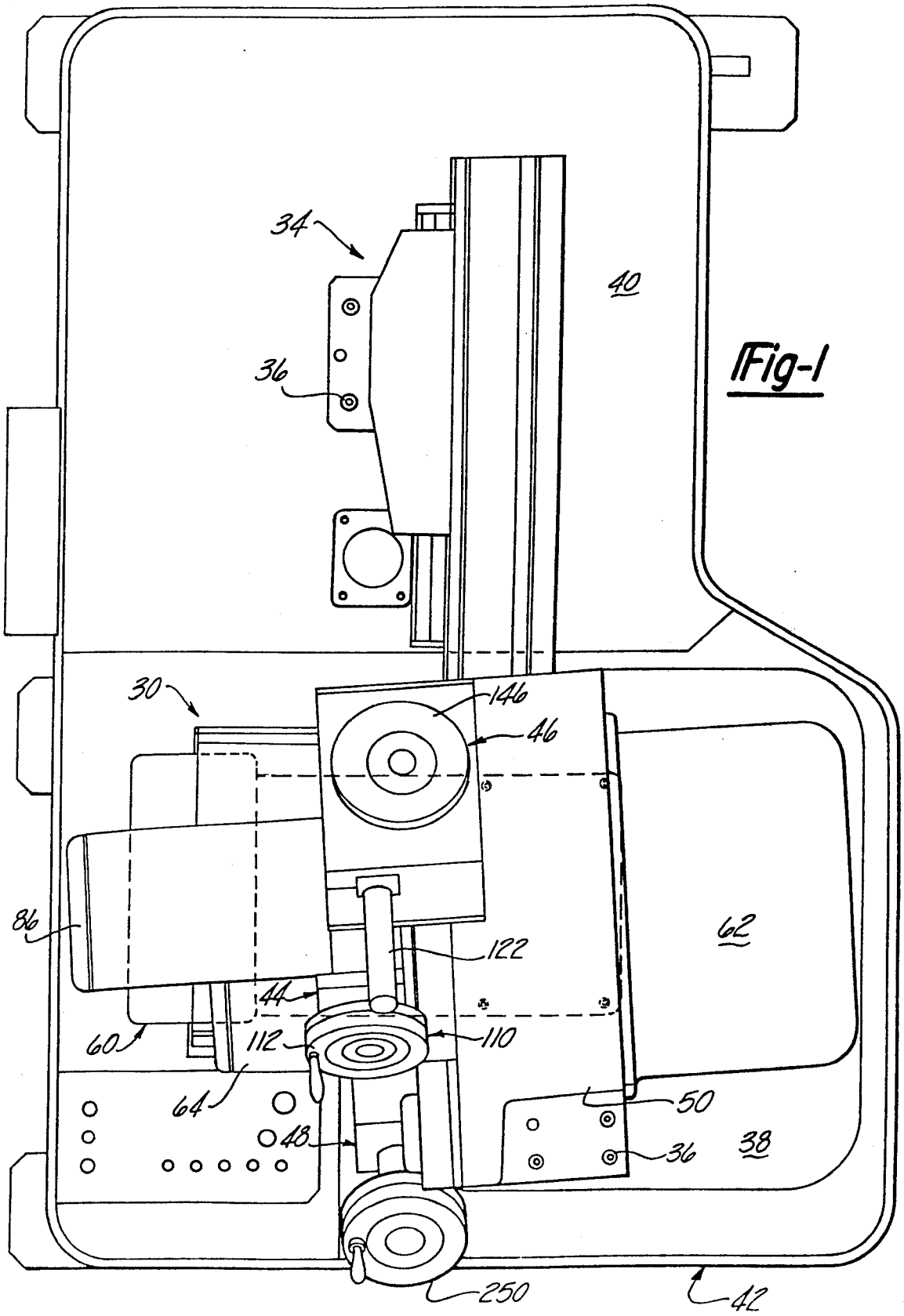
FIG. 1 is a plan view of a thread grinding machine embodying this invention.
Figure 3:
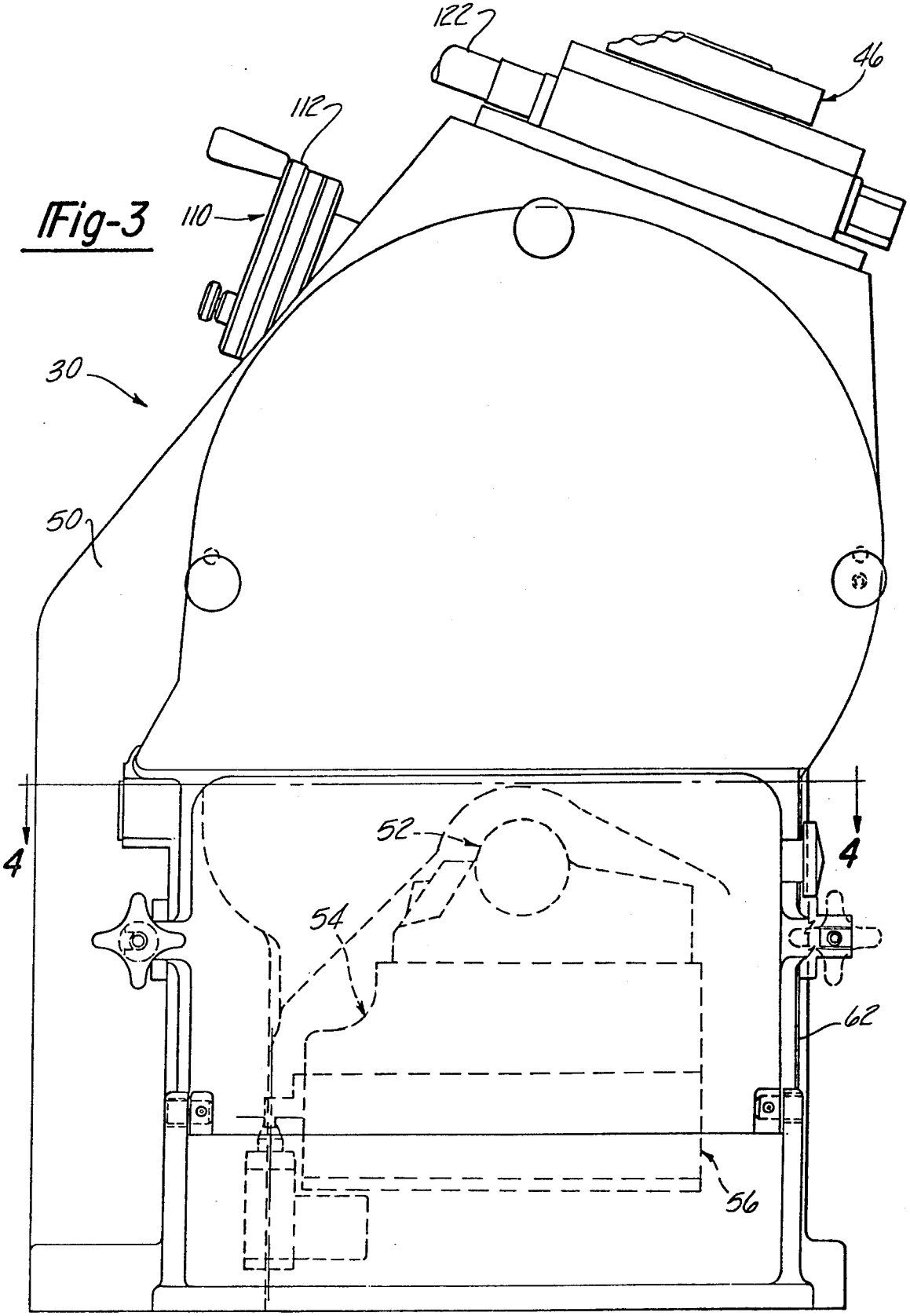
FIG. 3 is a fragmentary view of the other end of the grinding machine of FIG. 1.
Figure 14:
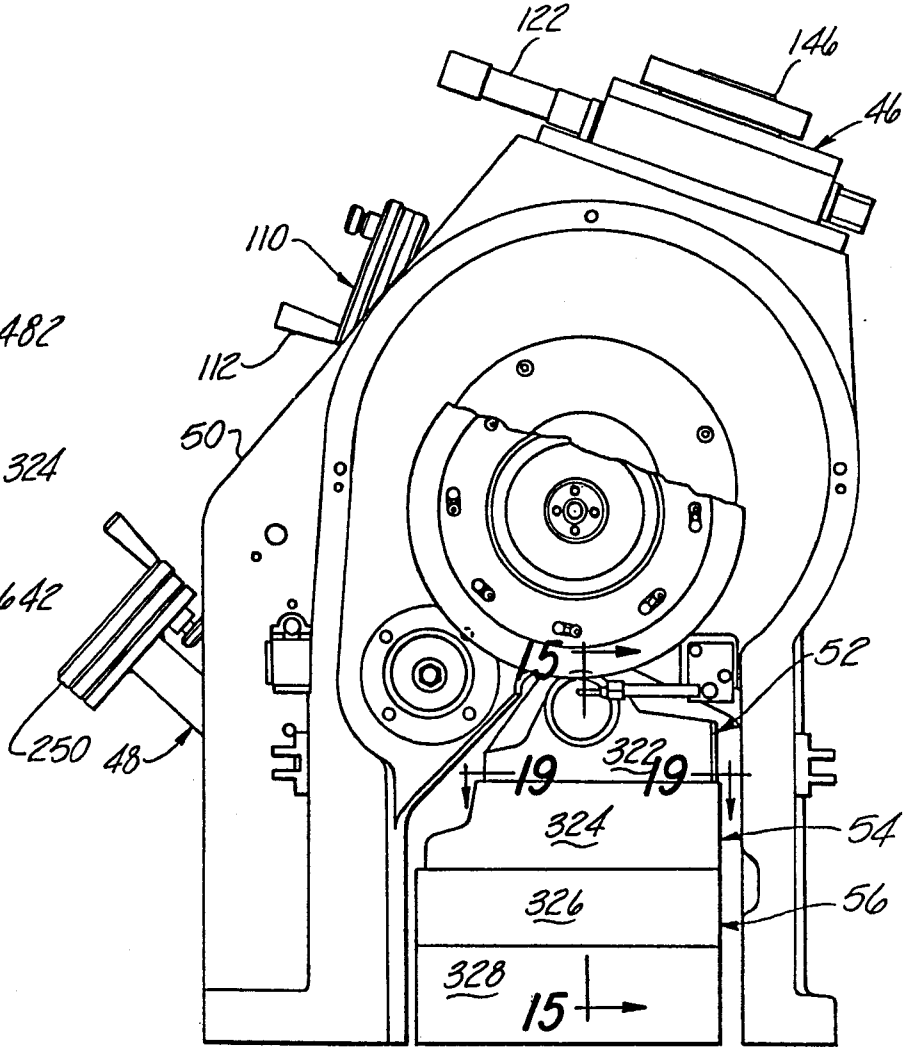

FIG. 14 is an end view of the grinding machine of FIG. 1 on a reduced scale with portions broken away and is similar to FIG. 3 except that an end cover has been removed to reveal the work head, relief, table, and sub-base assemblies.

Figure 4:
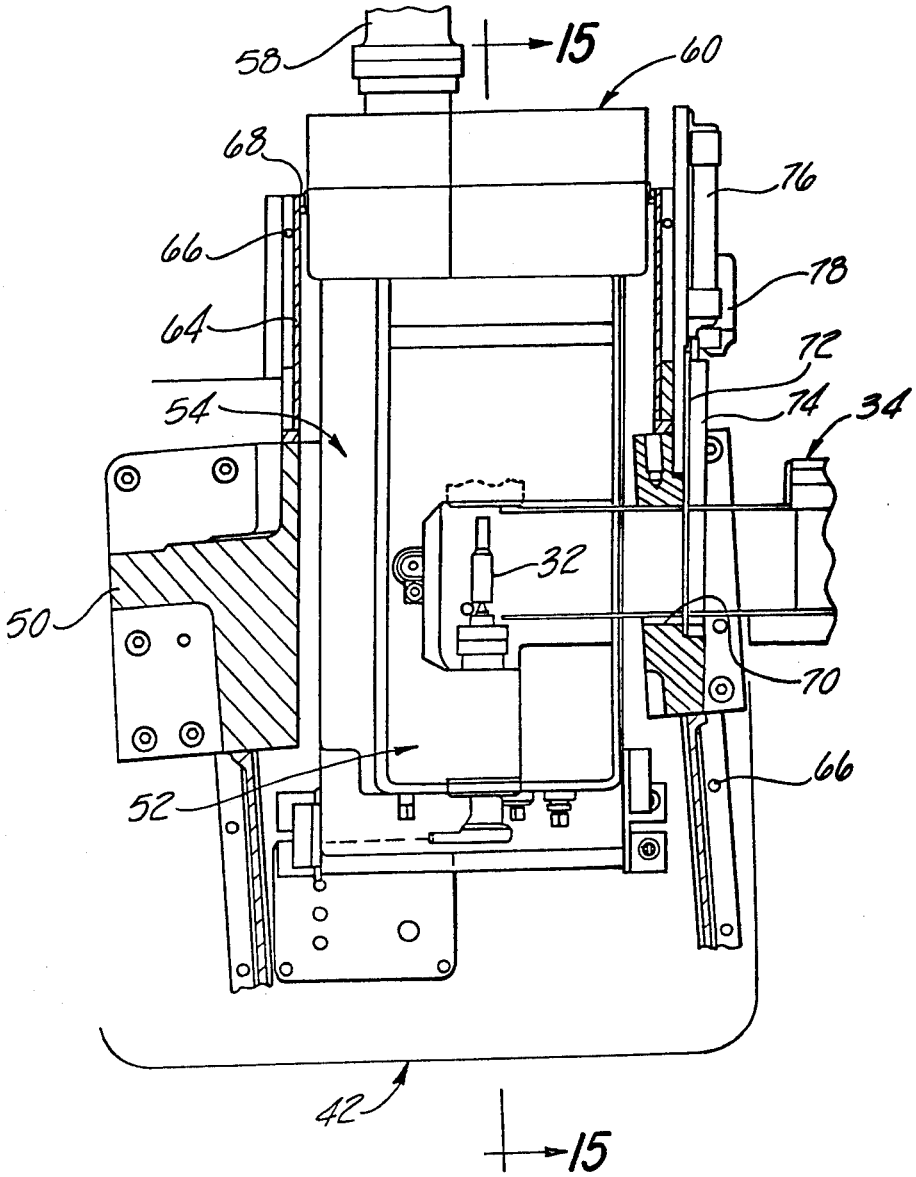
FIG. 4 is a fragmentary sectional view taken generally on line 4—4 of FIG. 3.
Figure 15:
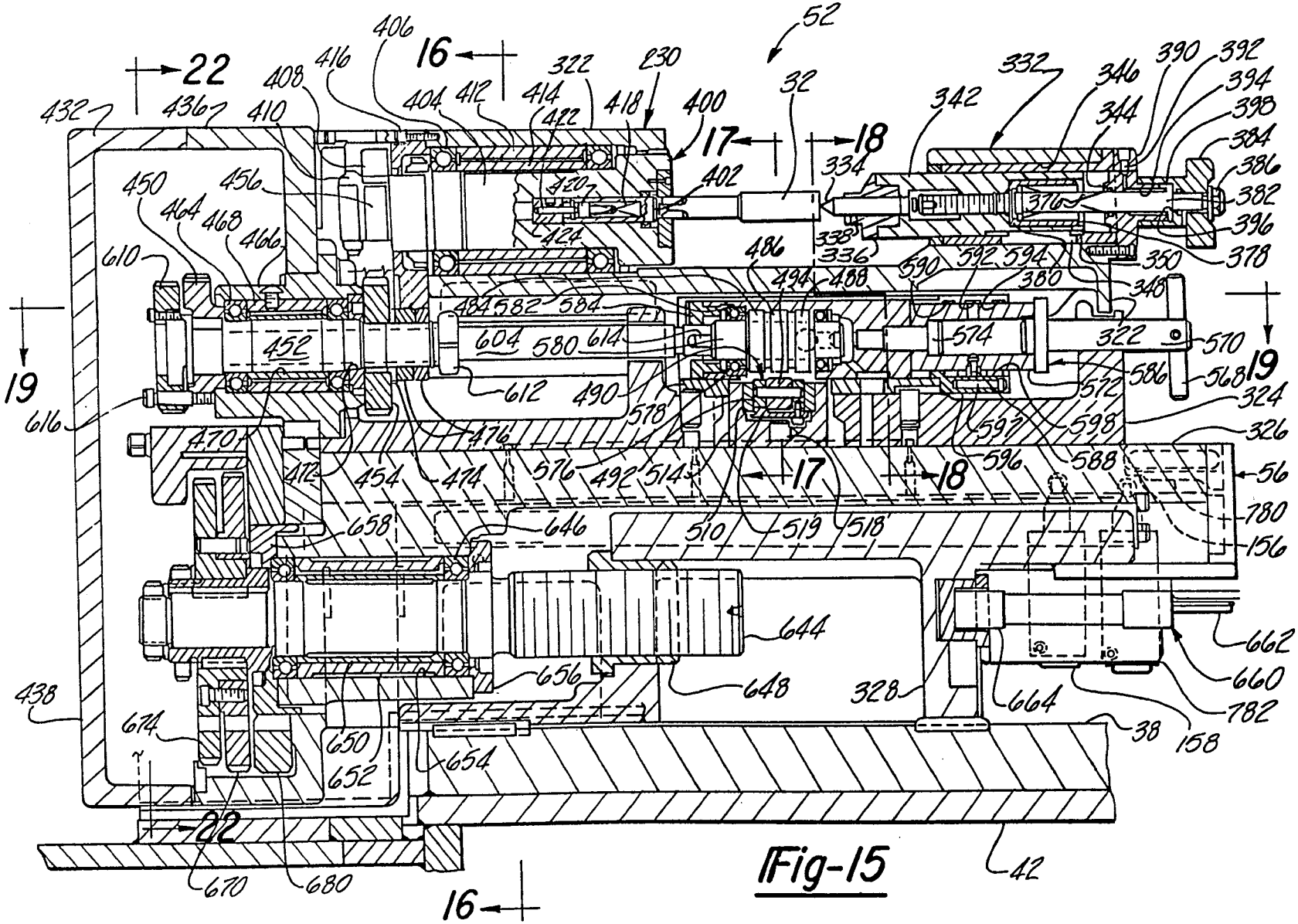

FIG. 15 is an enlarged sectional view taken generally on line 15—15 of FIGS. 4 and 14.

Figure 16:
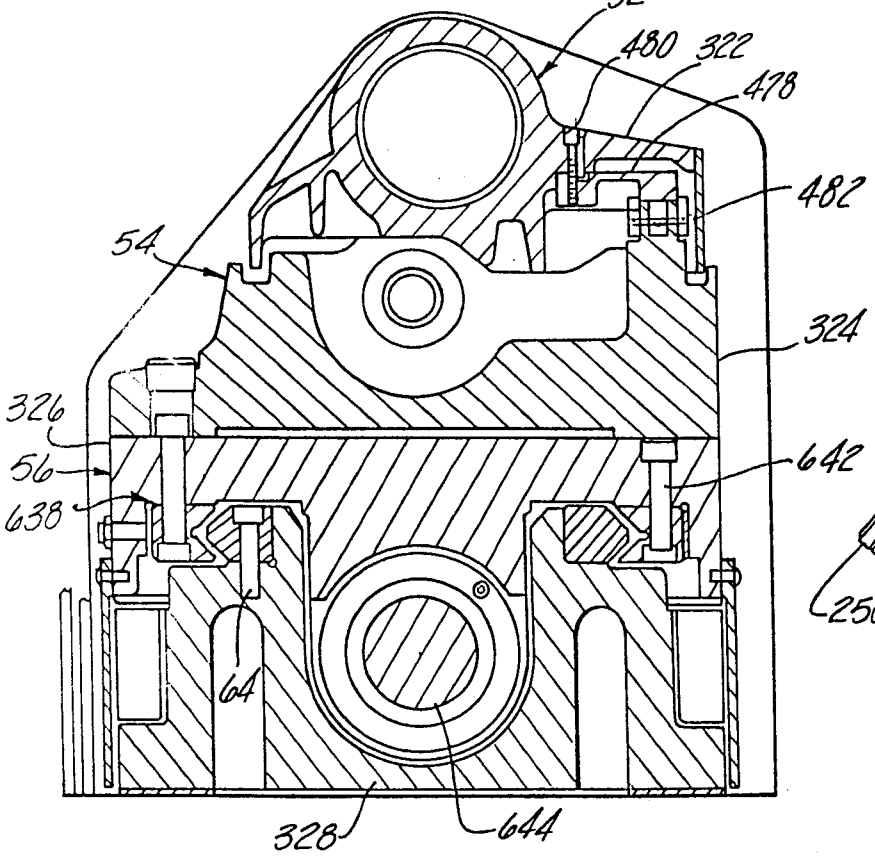
Figure 17:
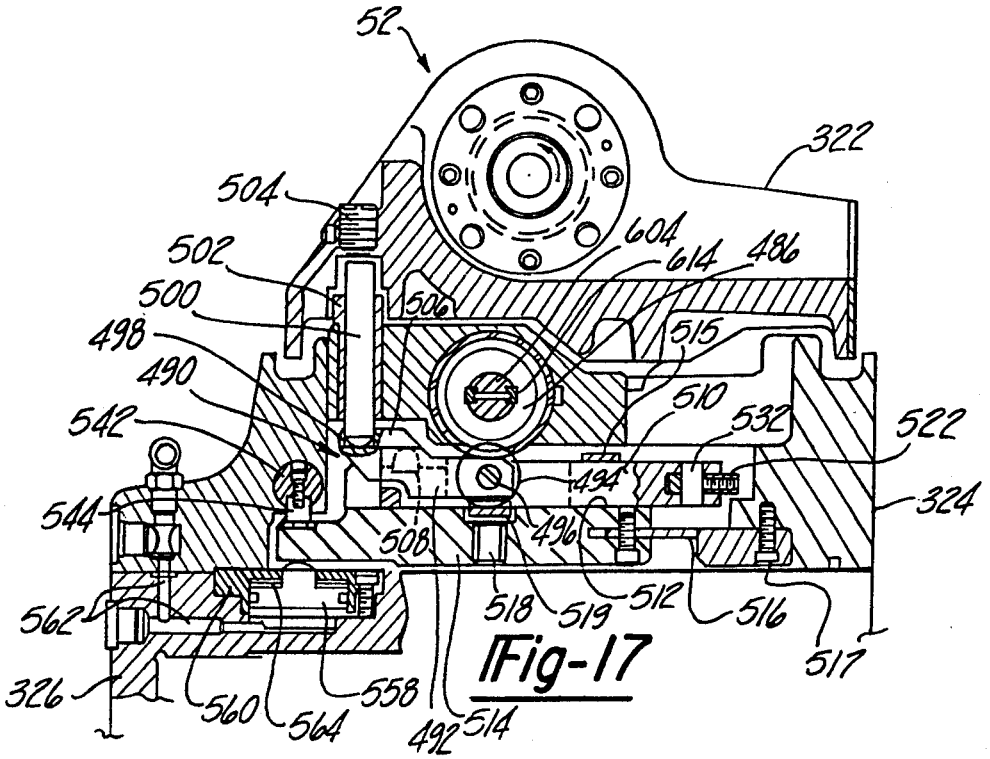
Figure 18:
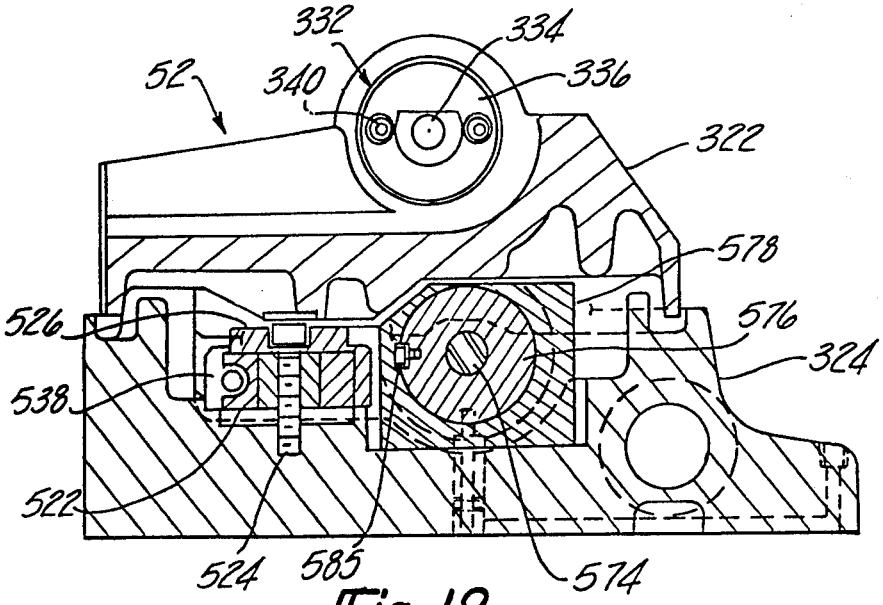

FIGS. 16, 17, and 18 are sectional views taken generally on lines 16—16, 17—17, and 18—18 respectively of FIG. 15.

Figure 19:
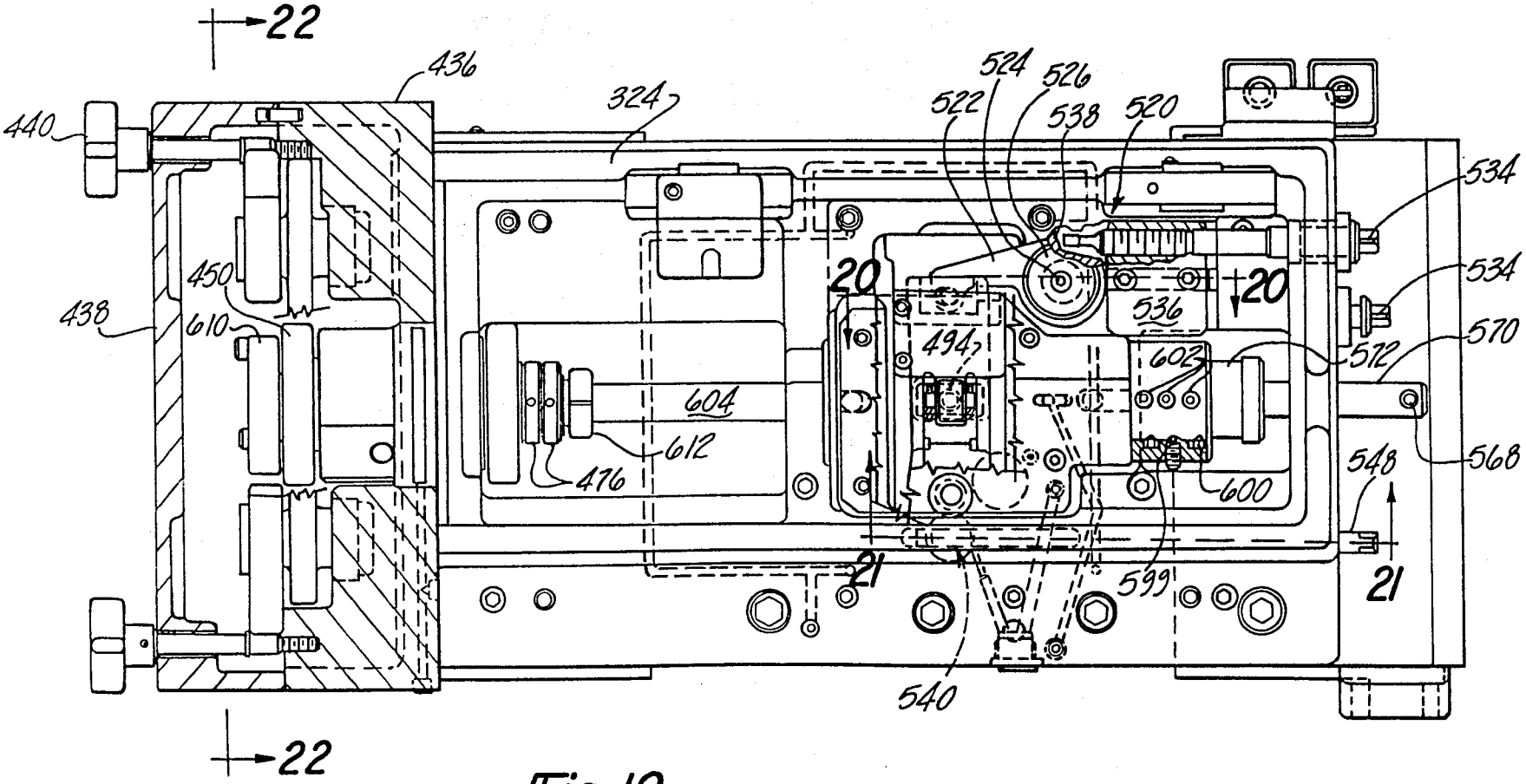

FIG. 19 is a top view taken generally on line 19—19 of FIGS. 14 and 15 with the workhead assembly removed and portions broken away to show the relief and table assemblies.

Figure 20:
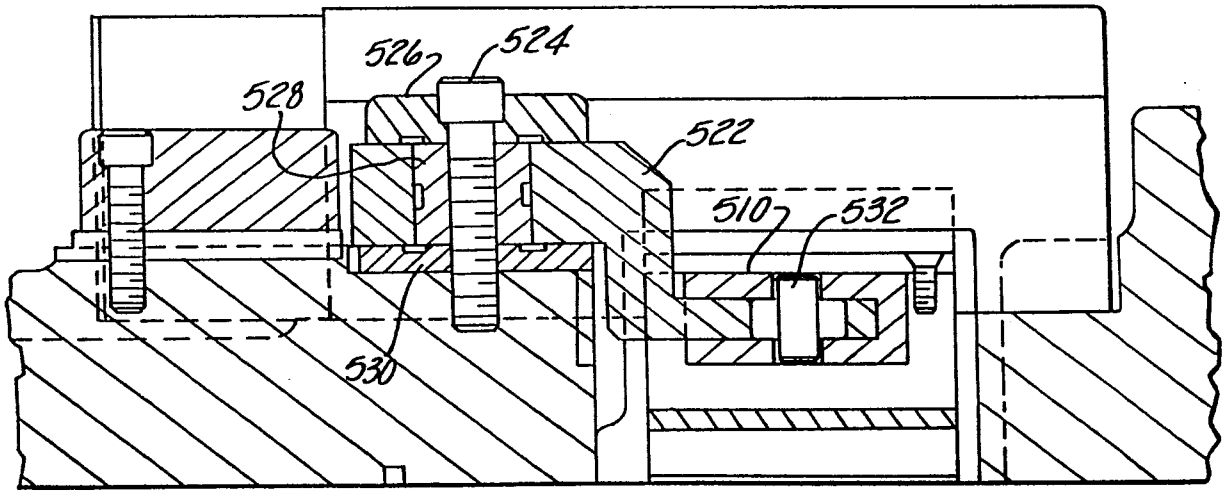
Figure 21:
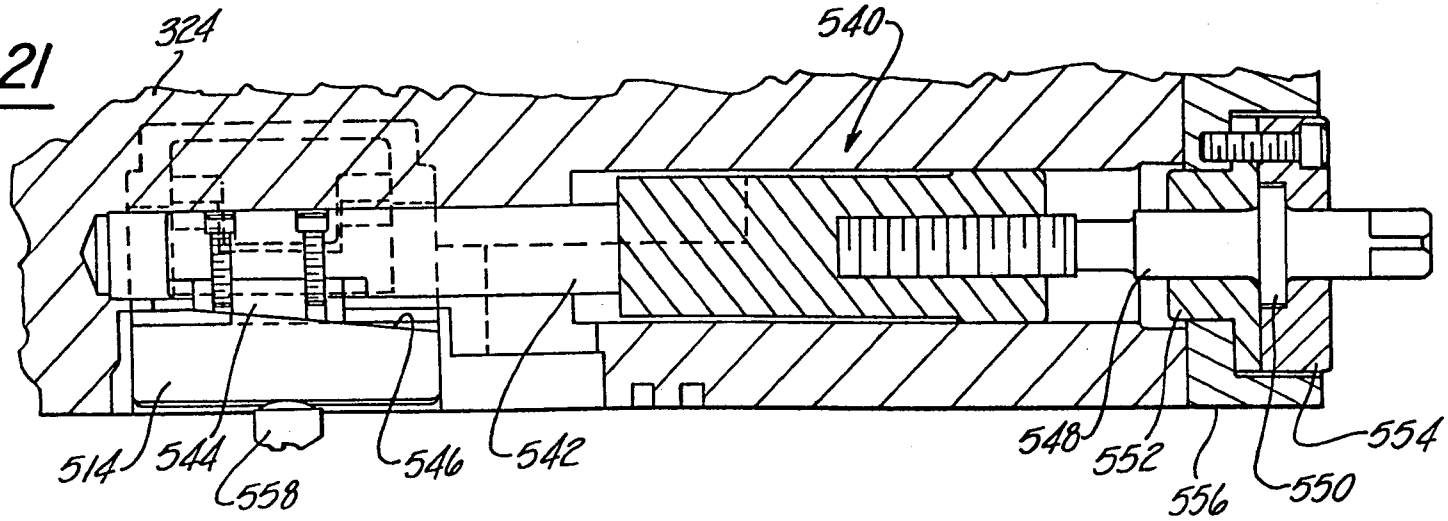

FIGS. 20 and 21 are fragmentary sectional views on lines 20—20 and 21—21 respectively of FIG. 19.

Figure 22:
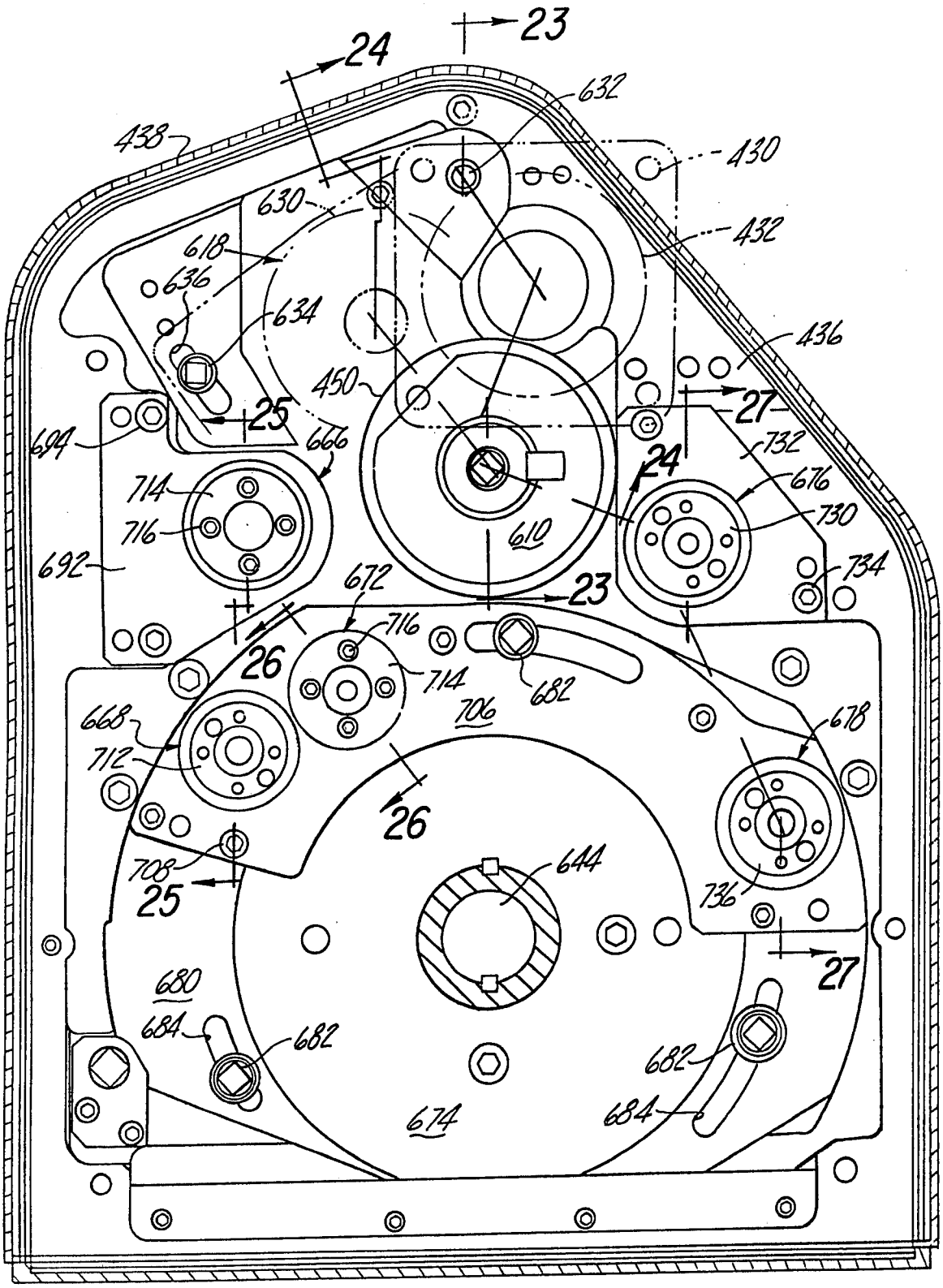

FIG. 22 is a sectional view taken generally on line 22—22 of FIG. 15 and 19 and showing the gear box and drive assembly of the grinding machine.

Figure 23:
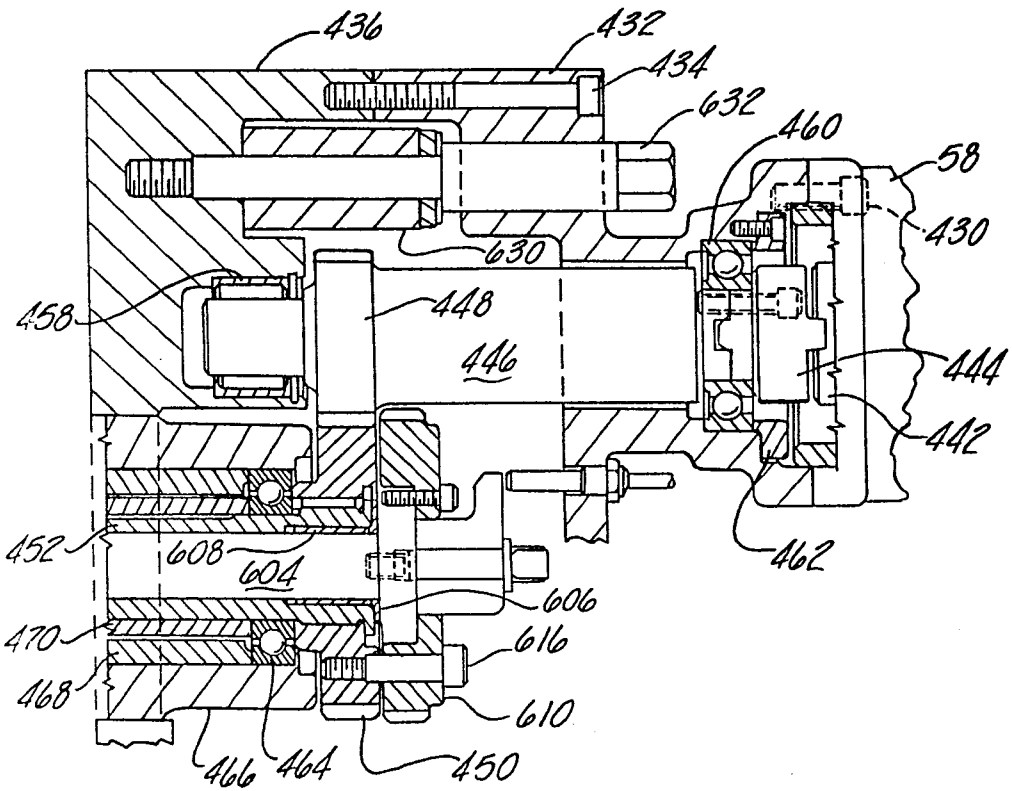

FIG. 23 is a sectional view taken generally on line 23—23 of FIG. 22 and showing a hydraulic drive motor and associated gearing of the grinding machine.

Figure 24:
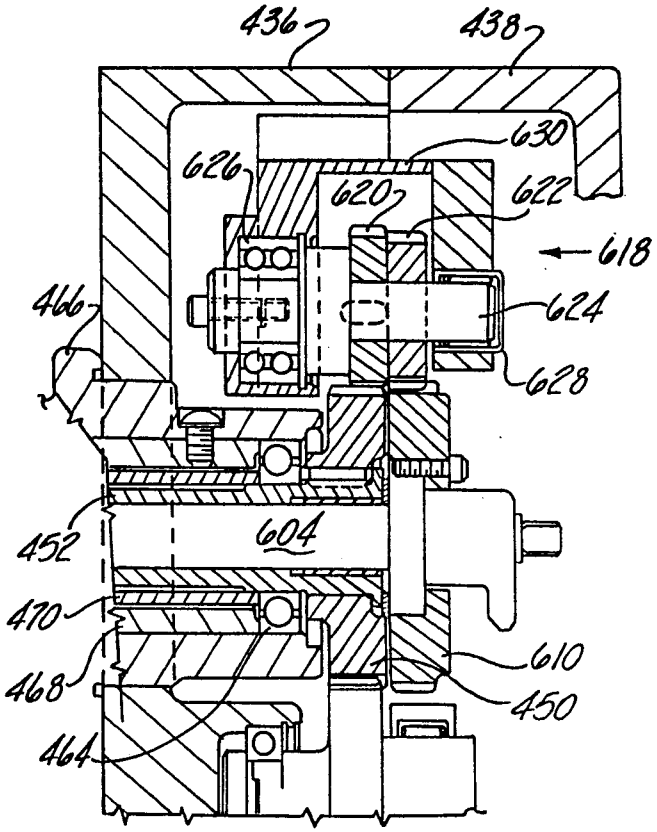

FIG. 24 is a sectional view taken generally on line 24—24 of FIG. 22 and showing the gearing arrangement for accommodating straight flute and spiral flute taps.

Figure 27:
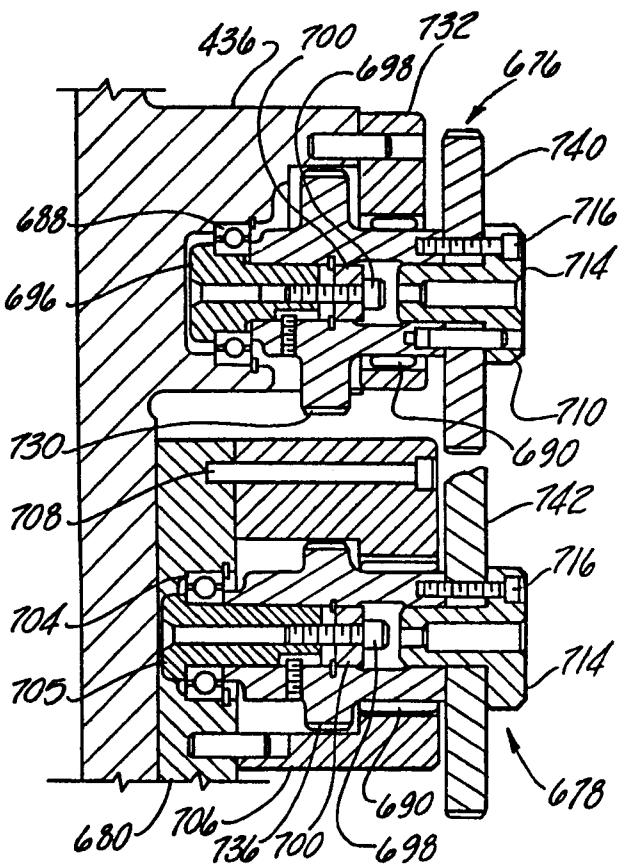
Figure 25:
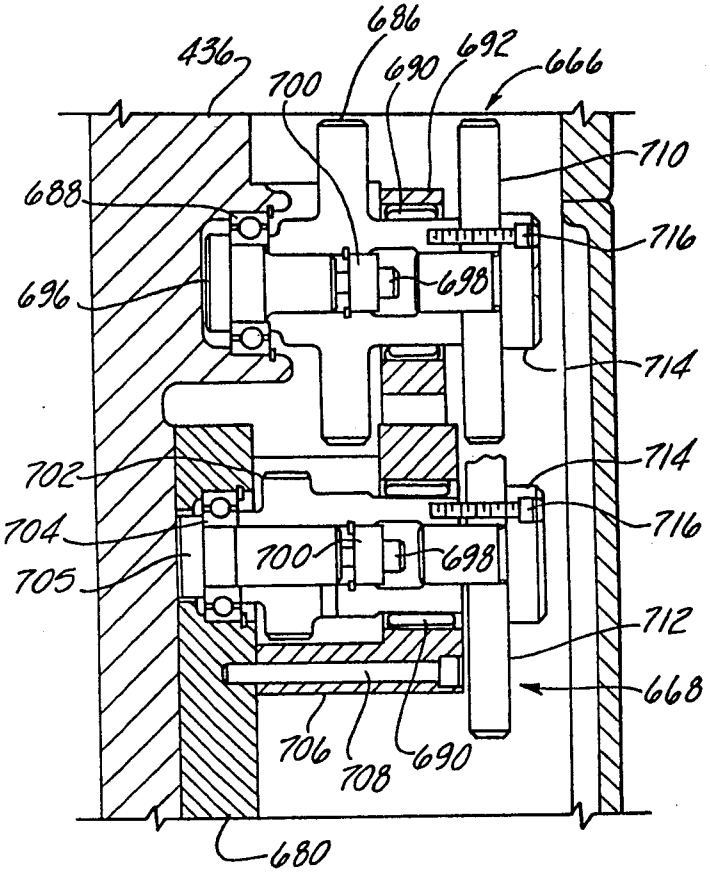
Figure 26:
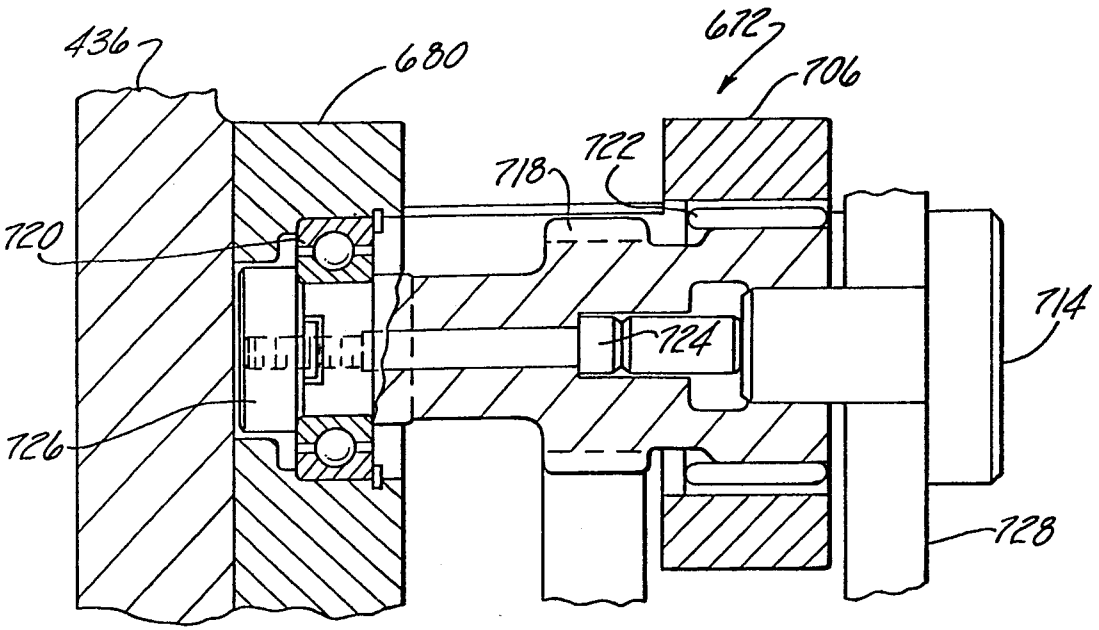

FIGS. 25, 26, and 27 are fragmentary sectional views taken generally on lines 25—25, 26—26, and 27—27 respectively of FIG. 22 and showing portions of the gearing arrangement for the metric, English fine and English coarse thread options of the grinding machine.

I. GENERAL LAYOUT

Referring in more detail to the drawings, FIGS. 1 through 4 illustrate the general layout of a grinding machine 30 embodying this invention for grinding threads on workpieces. Machine 30 can be used to produce extremely accurate threads on a large variety of workpieces such as lead screws, thread gauges, micrometer parts, fasteners, taps, and the like. However, to facilitate description of the construction and operation of the machine 30, only workpieces 32 (FIG. 4) on which cutting threads are ground to produce finished taps will be described in detail.

The workpeices 32 and finished taps are inserted into and removed from grinder 30 by a workpiece transfer mechanism 34. Grinder 30 and transfer mechanism 34 are mounted at a convenient work height on and secured by cap screws 36 to support plates 38 and 40 carried by a base 42.

Grinder 30 has a grinding wheel head assembly 44, a dial programmer 46 for automatically controlling the in-feed of the wheel head assembly, and a grinding wheel dresser assembly 48, all of which are carried by a horseshoe shaped frame 50 secured to the base 42. The workpiece to be ground is carried by a workhead assembly 52 (FIGS. 3 & 4) mounted on a relief mechanism housing 54, both of which are reciprocated in unison under the grinding wheel head assembly 44 by a table 56. The workhead assembly and table are driven by a hydraulic motor 58 through a gear box 60 mounted on the table for reciprocation therewith.

As shown in FIGS. 1 and 4, the grinding wheel and workhead assembly 44 are enclosed in a housing formed by a cover 62 and a shield 64 each secured by cap screws 66 to a base plate 38 and one side of frame 50. A flexible seal 68 is provided between shield 64 and gear box 60 which permits the gear box to reciprocate with respect to the shield.

II. TRANSFER OF WORKPIECES

As shown in FIG. 4, a workpiece 32 to be ground is transferred into grinder 30 and a finished tap is removed from the grinder by transfer mechanism 34 through a rectangular opening 70 in the side of frame 50. When transfer mechanism 34 is retracted, opening 70 can be closed off and sealed by a door 72 slidably received in a track 74 and opened and closed by a hydraulic cylinder 76. When door 72 becomes fully opened, it trips a limit switch 78, which through appropriate electrohydraulic circuitry, initiates cycling of transfer mechanism 34. Transfer mechanism 34 can be either of conventional design or the transfer mechanism described in Kushigian U.S. Pat. No. 4,209,087 issued on June 4, 1980, and filed on Aug. 16, 1979, as application serial number 134,146, the disclosure of which is incorporated herein by reference. In view of the disclosure of such Kushigian patent, transfer mechanism 34 will not be described in greater detail herein.

III. WHEEL HEAD ASSEMBLY

Figure 5:
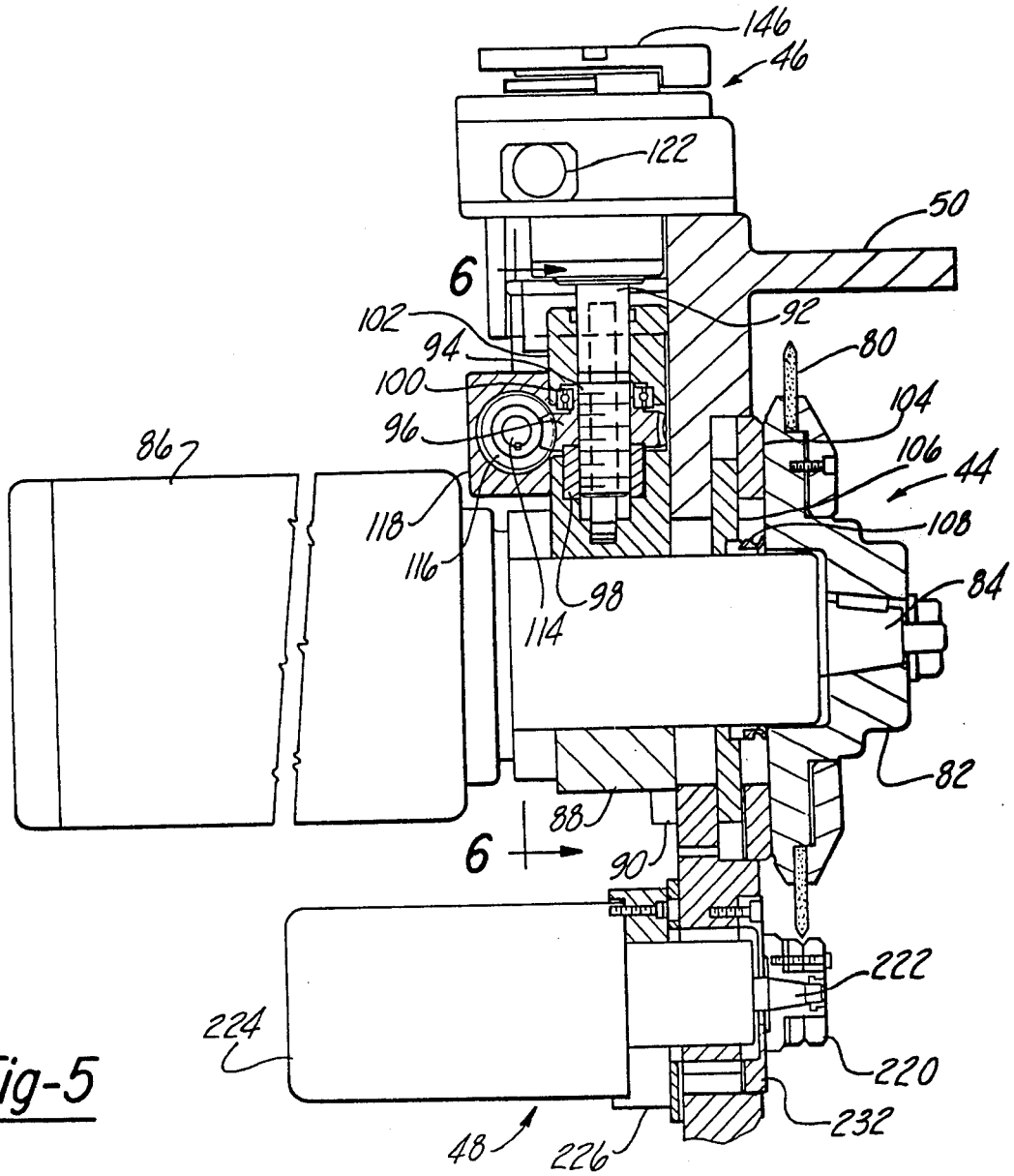
FIG. 5 is a fragmentary sectional view taken generally on line 5—5 of FIG. 2.

As shown in FIG. 5, wheel head assembly 44 has a grinding wheel 80 mounted by an arbor 82 on a drive shaft 84 of an electric drive motor 86 secured to a slide 88 mounted for reciprocal movement on roller bearing ways 90 secured by caps screws 91 to frame 50. Grinding wheel 80 is fed into the workpiece by a shaft 92, with external threads 94 engaging mating internal threads in a worm gear 96 mounted for rotation in and movement with slide 88 by a thrust bearing 98 pressed in a counterbore in the slide and a ball bearing 100 received in a mounting block 102 secured to slide 88. A fluid seal is provided between motor 86 and grinding wheel 80 by a pair of overlapped plates 104 and 106 and a flexible seal 108 carried by plate 106.

Figure 6:
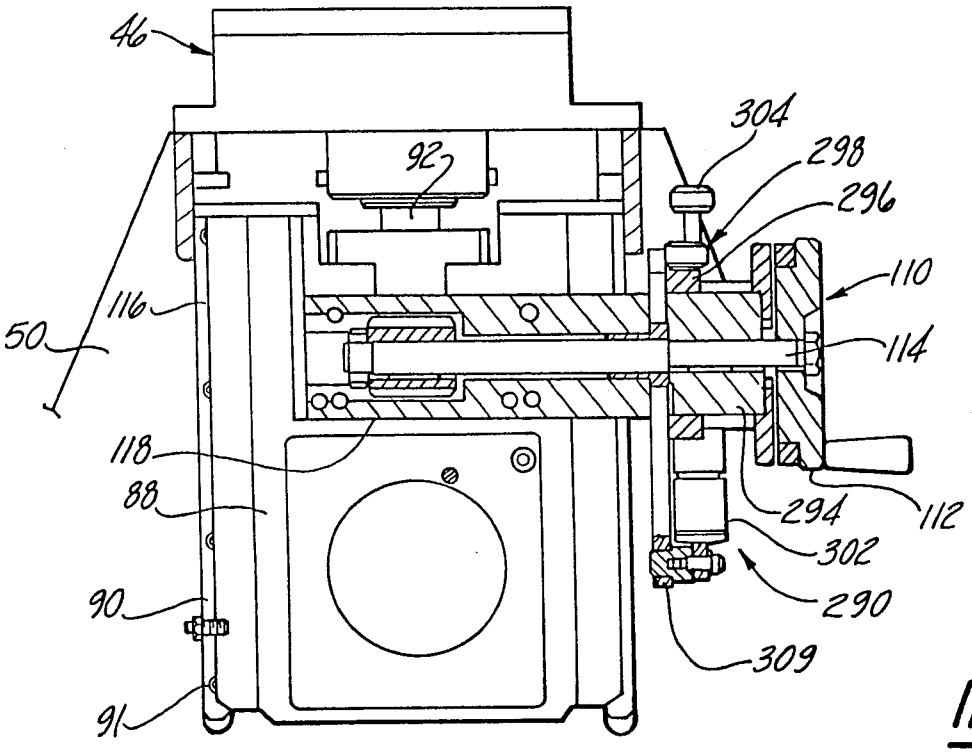
FIG. 6 is a fragmentary sectional view taken on line 6—6 of FIG. 5.

As shown in FIGS. 5 and 6, a manual gross feed mechanism 110 for advancing and retracting grinding wheel 80 is provided by a hand wheel 112 secured to one end of a shaft 114 having a worm 116 keyed thereto which meshes with gear 96. Shaft 114 is journaled in a housing 118 mounted by cap screws 120 (FIG. 2) on slide 88.

IV. DIAL PROGRAMMER

Figure 7:
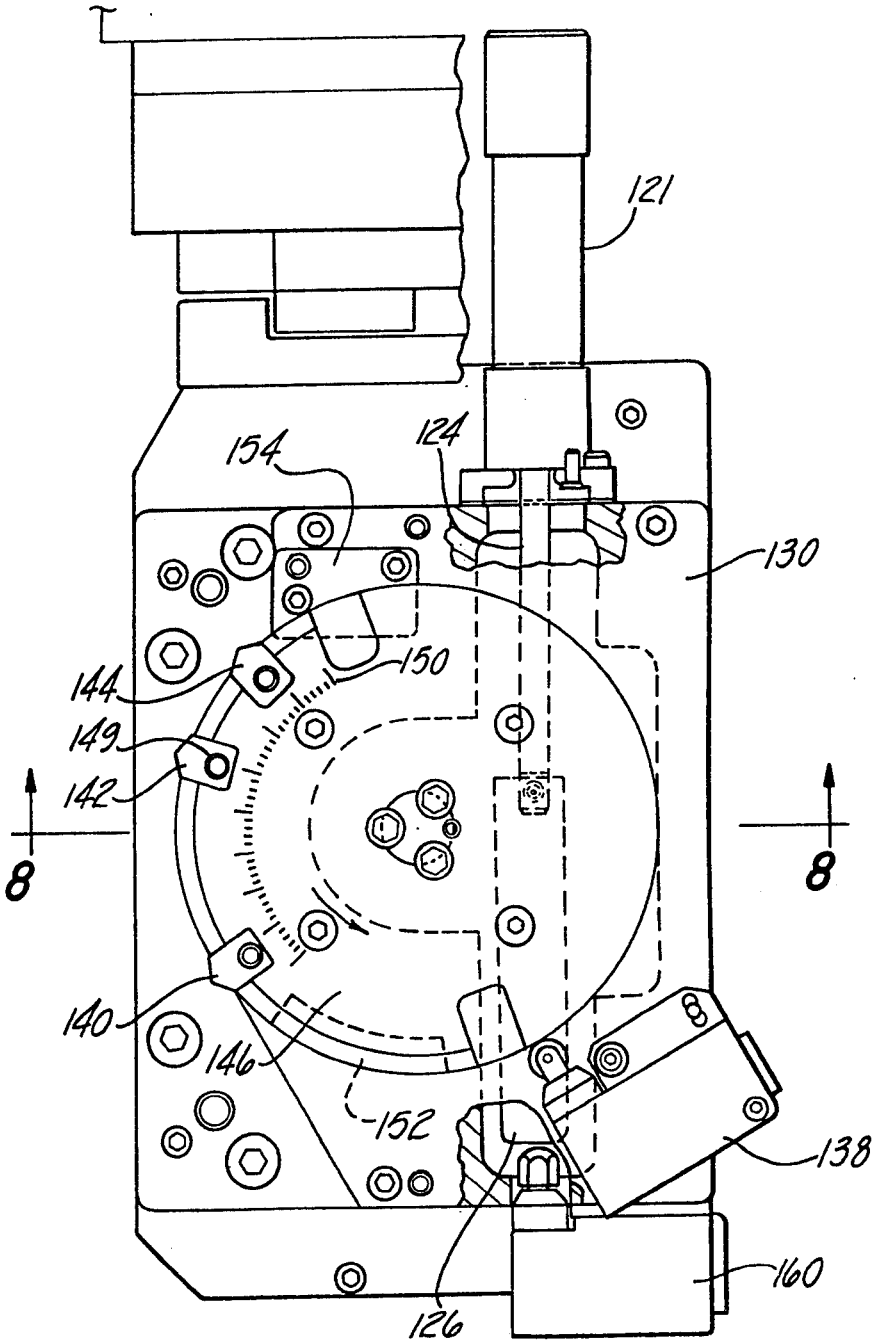
FIG. 7 is a fragmentary top view with portions broken away of the dial programmer of the grinding machine of FIG. 1.
Figure 8:
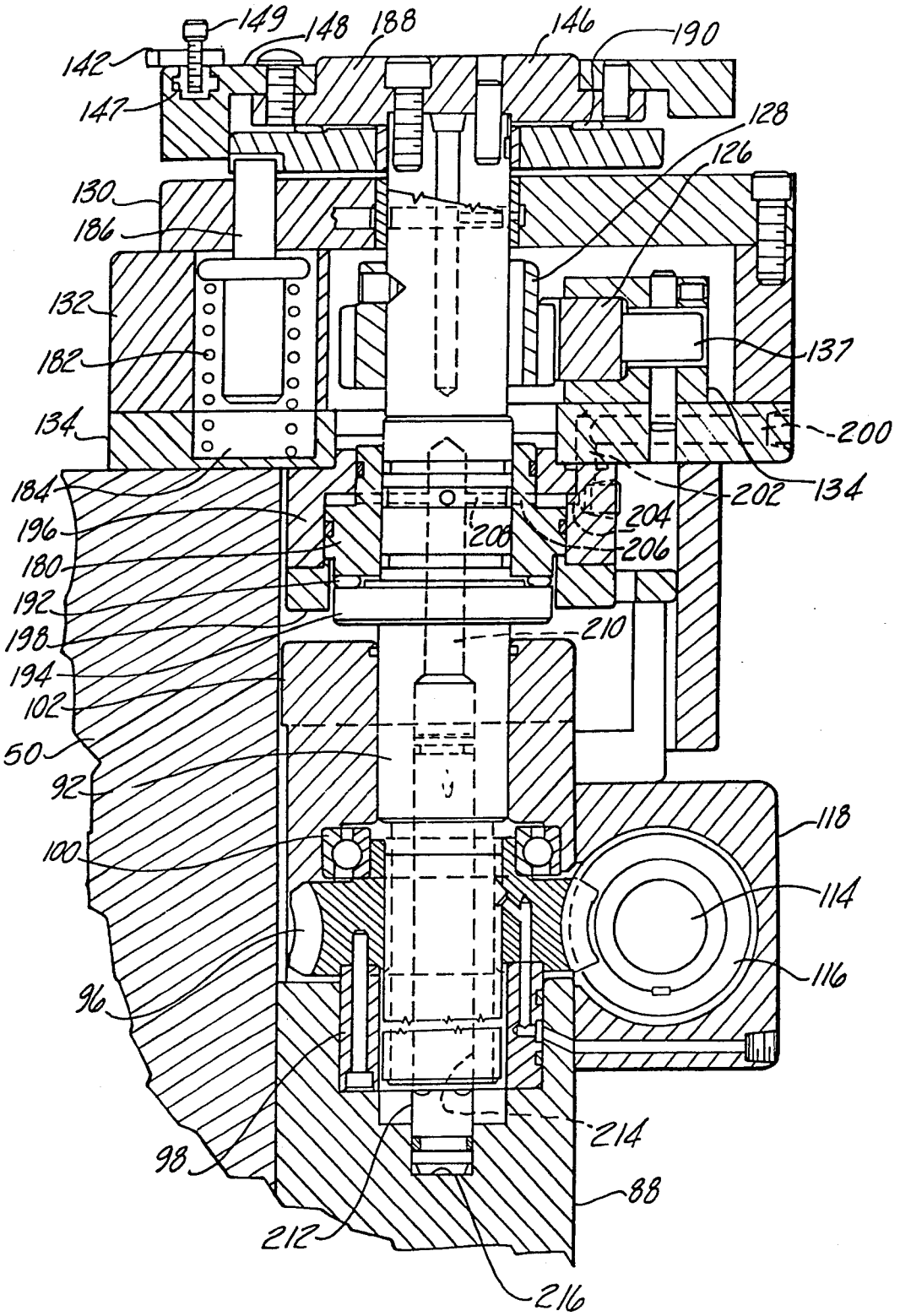
FIG. 8 is a fragmentary sectional view taken generally on line 8—8 of FIG. 7.

In grinding cutting threads on a workpiece, usually two or three feeds of the grinding wheel into the workpiece are required. These infeeds can be provided automatically by dial programmer 46 which permits the depth of each rough grinding infeed to be individually selected by controlling the extent of rotation of feed screw 92. As shown in FIGS. 5, 7, and 8, feed screw 92 is rotated by a hydraulic cylinder 122 with a rod 124 connected to a rack 126 which meshes with a spur gear 128 keyed to the feed shaft 92. Cylinder 122 is secured to a housing comprising a cover plate 130 secured to a housing plate 132 secured to a base plate 134 mounted on the upper end of frame 50. Rack 126 is slidably received in a retainer 136 secured to base plate 134 and having a plurality of rollers 137 therein bearing on the rear face of the rack.

The extent to which hydraulic cylinder 122 rotates feed shaft 92 to feed the grinding wheel into a workpiece for rough grinding passes is controlled through appropriate electrohydraulic circuitry (not shown) by cooperation of a limit switch 138 with actuator dogs 140, 142, and 144 carried by a dial 146 secured to the upper end of feed shaft 92 for rotation therewith. These dogs are slidably received in a T-shaped track 147 in an outer ring 148 of dial 146 and may be releasably locked by cap screws 149 in the track at predetermined angular positions corresponding to the desired extent of feed of the grinding wheel into the workpiece for each rough grinding pass of the wheel through the workpiece. To facilitate locating the rough grinding dogs to produce the desired infeed, a scale 150 (FIG. 7) on dial 146 indicates in both thousandths of an inch and hundreths of a millimeter the amount of infeed produced by rotation of screw 92 relative to the finish pass position of the grinding wheel.

For the finish pass of the grinding wheel, screw 92 is rotated so that a fixed dog 152 (FIG. 7) on the underside of dial 146 bears on a stop 154, thereby providing a positive stop for and accurate control of the infeed for the finish pass of the grinding wheel through the workpiece. The finish pass of the grinding wheel is initiated and controlled through appropriate electrohydraulic circuitry (not shown) by the actuation of a pressure responsive switch 154 (not shown). Switch 154 changes state in response to the increase in pressure of the hydraulic fluid being supplied to cylinder 122 which occurs when dog 152 bears on stop 154.

After the finish pass is complete, a dog 156 on table 56 trips a limit switch 158 (FIG. 15) which, through appropriate electrohydraulic circuitry (not shown), actuates cylinder 122 to return the dial programmer to its initial starting position. To indicate that the dial programmer has returned lead screw 92 to its starting postion, a limit switch 160 (FIG. 7) is actuated by rack 126 when it is fully extended by cylinder 122.

V. RAPID ADVANCE

The grinding wheel can also be automatically rapidly advanced or retracted a relatively short distance exceeding the depth of the threads ground in the workpiece by a fluid actuated piston 180 against the bias of a return spring 182. Spring 182 is received in a pocket 184 and urges a plunger 186 into engagement with a transfer plate 188 slidably received over the upper end of feed shaft 92 and bearing on a thrust washer 190 engaging the underface of disc 146 which is fixed to the shaft.

Piston 180 is a sleeve slidably received over feed shaft 92 and engaging a thrust washer 192 bearing on a flange 194 on the shaft. Piston 180 is also slidably received in a cylinder formed by a ring 196 fixed to plate 134, and is retained in the cylinder by a retainer ring 198 secured to the lower end of the cylinder ring 196. Hydraulic fluid is admitted to the cylinder to advance piston 180 through interconnecting passages 200, 202, and 204. To eliminate backlash between feed screw 92 and worm gear 96, hydraulic fluid also flows through passages 206, 208, and 210 to act on one end of a piston rod 212 slidably received in a bore 214 in feed screw 92 and having its other end received in and bearing on the bottom of a blind hole 216 in wheel head slide 88.

VI. DRESSER ASSEMBLY

As shown in FIGS. 2, 5, and 9, dresser assembly 48 has a dressing wheel 220 mounted on a spindle 222 of a drive motor 224 secured to one end of a carrier arm 226, the other end of which is pivotally mounted by a bearing 228 and cap screws 230 on horseshoe frame 50. As shown in FIG. 5, a flexible seal 232 of a material such as neoprene rubber is provided between the shaft of the dressing motor and frame 50 which forms a portion of the housing enclosing the grinding wheel. As shown in FIG. 9, the dressing wheel is yieldably urged toward its retracted position by a spring 234, one end of which is received in a blind hole 236 in a retainer block 238 fixed to frame 50 by cap screws 240 and the other end of which is received in a hole 242 in the arm 226 and bears on a plate 244 fixed to the arm. Clearance is provided for retainer block 238 by a generally rectangular hole 246 in the arm which is covered by a plate 248 which overlies and is secured to the retainer block 238 by the cap screws 240.

The dressing wheel is manually advanced and retracted by rotating a hand wheel 250 to extend and retract a plunger 252 bearing on a wear plate 254 fixed to dresser arm 226. As shown in FIGS. 10 and 11, hand wheel 250 is fixed to one end of a shaft 255 journaled in a housing 254 by bearing 256 and 258 and keyed to a worm 260, which meshes with a worm gear 262. Worm gear 262 is journaled for rotation in housing 254 by a thrust bearing 264 and a roller bearing 266 and retained therein by a cap 268 secured to the housing. Worm gear 262 has internal threads which mesh with external threads on the shank of a retainer 270 in which plunger 252 is slidably received and retained by a collar 272. Retainer 270 is mounted by caps 268 and 274 for reciprocation in housing 254 in response to rotation of worm gear 262 and is prevented from rotating by a key 276 secured to the housing and projecting into a groove 278 in the retainer 270.

To rapidly advance the dressing wheel, plunger 252 may be advanced a predetermined distance by the admission of hydraulic fluid under pressure through ports 280, 282, and 284 to act on the end face of shank 286 and piston 288 of plunger 252. When the pressure of this hydraulic fluid is relieved, plunger 252 is returned or retracted by the force produced by spring 234.

The grinding wheel may be automatically dressed and compensated for such dressing by cooperation of dresser wheel assembly 48 with a one-way drive mechanism 290 shown in FIGS. 2, 6, and 12 which rotates the gross feed mechanism 10 to infeed the grinding wheel a predetermined distance. Mechanism 290 has a one-way clutch 292 with a hub 294 secured to shaft 114 for rotation therewith and a split band 296 encircling the hub and secured together by an adjustable clamp assembly 298. Band 296 and hub 294 are rotated in unison counterclockwise (as shown in FIG. 12) to turn shaft 114 and, hence, infeed grinding wheel 80 by advancement of a piston rod 300 of a hydraulic cylinder 302 connected to the band. Band 296 slips with respect to hub 254 and, hence, shaft 114 is not turned, when the band is rotated counterclockwise by retracting the piston rod 300 of the cylinder. The extent of infeed of grinding wheel 80 by mechanism 290 is adjusted and controlled by a stop screw 304 threaded through a bracket 306 and positioned to bear on an abutment 308 on the band. Bracket 306 and hydraulic cylinder 302 are mounted on a carrier plate 309 fixed to housing 114.

The extent of the feed of the dressing wheel can be indicated in either the English or metric systems by graduated scales 310 and 311 respectively (FIG. 9) on the periphery of wheel 250. So that the feed can be in true English or metric units and both scales may be graduated in whole numbers, such as thousandths of an inch and hundredths of a millimeter, housing 254 is mounted on frame 50 so that it can be shifted generally longitudinally to two spaced apart positions to shift the point at which plunger 252 contacts arm 226 relative to pivot point 312 of the arm so that one complete revolution of hand wheel 250 feeds the dressing wheel an amount which is an integer or whole number of units in either the English or metric systems of lineal measurement.

These positions of housing 254 are located by a pin 313 fixed in frame 50 and extending through an elongate slot 314 in housing 254 so that when the housing is secured to the frame with the pin bearing on the lower end of the slot (as shown in FIG. 9), the English scale 310 will correctly indicate the extent of displacement of the dressing wheel and when housing 254 is shifted so that pin 313 bears on the upper end of slot 314, the metric scale 311 will correctly indicate the displacement of the dressing wheel.

VII. GRINDING WHEEL, DRESSER, AND WORKPIECE GEOMETRY

In accordance with another feature of this invention, the geometric relationship, location, and construction of the grinding wheel, dresser, and workpiece are arranged to minimize the effects of thermal expansion and eliminate the errors associated with previously known dual screw compensation of the grinding wheel feed for dressing of the wheel, thereby significantly improving the overall accuracy of the thread grinding machine. As shown in the schematic diagram of FIG. 13, the points of contact 315 and 316 of the workpiece 32 and dresser wheel 220 with grinding wheel 80 are on the same side of the wheel and equally angularly spaced from and on opposite sides of the centerline 317 of the wheel which is parallel to the path of feed of the wheel by slide 88 into the workpiece. The dresser arm is pivotally mounted to move in an arc 318, the radius R and center 312 of which are predetermined so that when the dressing wheel contacts the grinding wheel, point 316 will be symmetrical about centerline 317 with the point 315 at which the grinding wheel contacts the workpiece throughout the expected range of diameters of the workpiece and expected range of diameters and locations of the grinding wheel.

By knowing the diameter and range of locations of the grinding wheel, the range of diameters of the workpieces, and the diameter of the dresser wheel, and assuming a fixed distance D between the center of workpiece 32 and centerline 317, the extreme and middle positions 319, 320, and 321 of the center of dresser wheel 220 can be calculated. Using these three positions and conventional formulas for calculating the radius and location of the center of curvature of an arc, the radius R and location of the pivot point 312 of the dresser arm 226 can be determined.

For example, if the diameter of the grinding wheel is about 18.0 inches, diameter of the dresser wheel is about 2.5 inches, the range of diameters of the workpieces is about 0.2 to 0.8 inches, and the distance D is about 3.0 inches; then the radius R of the dresser arm is about 8.4 inches and the location of its pivot point 312 is given by x~2.3 and y~11.2 inches.

VIII. WORKHEAD ASSEMBLY

As shown in FIGS. 4 and 15, the workpiece 32 is carried by workhead assembly 52 for rotation and reciprocation under grinding wheel 80. The workhead assembly has a workpiece carrier housing 322 mounted on a cam shaft housing 324 secured to a face plate 326 of table 56 which is mounted for reciprocation on a sub-base 328 fixed to mounting plate 38 of the base 42. As shown in FIG. 15, workpiece 32 is carried by headstock and tailstock assemblies 330 and 332.

TAILSTOCK

Tailstock 332 has a dead center 334 slidably received in an end member 336 and secured therein by a screw 338. End member 336 is secured by cap screws 340 (FIG. 18) to a sleeve 342 slidably received in a bushing 344 received in a bore 346 in housing 322. Sleeve 342 and, hence, center 334 is prevented from rotating by a key 348 received in bushing 344 and projecting into a groove 350 in the sleeve.

Center 334 and sleeve 342 are yieldably biased to the extended postion shown in FIG. 15 by a spring 376 one end of which is received in and bears on a collar 378 which is slidably received in a counterbore in the sleeve and bears on an enlarged central portion 380 of an actuator shaft 382, one end of which is threaded into a bore in the sleeve. To adjust and control the extent to which center 334 and sleeve 342 can be advanced, shaft 382 may be rotated by manually manipulating a knob 384 secured by a nut 386 to the shaft. Center 334 and sleeve 342 can be retracted in unison, either by manually pulling on knob 384 or by admitting hydraulic fluid under pressure through port 392 and bore 394 to act on a piston face formed by the end of counterbore 396 in the knob which is slidably received over a neck of the end cap with a seal 398 therebetween.

HEADSTOCK

Headstock assembly 330 has a drive assembly 400 with a center pin 402 carried by a drive sleeve 404 mounted for rotation in housing 322 by ball bearings 406 and having a gear 408 keyed to one end of the sleeve and retained thereon by a nut 410. Bearings 406 are entrapped between housing 322, spacer sleeves 412 and 414, and an end plate 416 secured to the housing by cap screws.

Center pin 402 is slidably received in sleeve 404 and yieldably biased toward its extended position by a spring 418 received in a blind hole in the pin and bearing on a plunger 420 slidably received in the hole and retained therein by a snap ring. Plunger 420 bears on a stop pin 422 secured by a set screw to an abutment bushing 424 on which the center pin 402 bears when moved to its fully retracted position shown in FIG. 15.

IX. WORKPIECE DRIVE

Workpiece drive assembly 400 is driven by hydraulic motor 58 (FIG. 19) through a gear train. As shown in FIG. 23, drive motor 58 is mounted by cap screws 430 on an auxiliary cover section 432 secured by cap screws 434 to housing 436 of gear box 60. A removable main cover section 438 underlies and is secured by screws 440 to the remainder of housing 436. The drive shaft 442 of the motor is connected by a coupler 444 to an intermediate shaft 446 with an integral spur gear 448 which meshes with a spur gear 450 (FIGS. 15 and 23) keyed on one end of an intermediate sleeve 452 having a gear 454 (FIG. 15) keyed on its other end which meshes with gear 408 on the sleeve of the workpiece drive assembly.

Intermediate shaft 446 is journaled for rotation by a roller bearing 458 (FIG. 23) retained in housing 436 by a snap ring, and a ball bearing 460 retained in auxiliary cover 432 by a retainer ring 462 secured thereto. Sleeve 452 (FIG. 15) is journaled by bearings 464 received in a collar 466 secured to gear housing 436. Bearings 464 are spaced apart by a pair of spacer sleeves 468 and 470 and gear 454 is retained on sleever 452, by spacer rings 472 and 474 and nuts 476.

X. RELIEVING MECHANISM

In accordance with another feature of this invention, the threads being ground on a workpiece are relieved by advancing the rotating workpiece toward the grinding wheel while grinding a segment of a thread between adjacent flutes and then retracting the workpiece while the grinding wheel passes through the adjacent flute area so that the workpiece can again be advanced while grinding the next thread segment. When producing relieved threads, the workpiece is advanced and retracted by pivotally moving the workpiece housing 322 toward and away from the grinding wheel. As shown in FIG. 16, workpiece housing 322 is mounted on cam housing 324 for pivotal movement with respect to grinding wheel 80 by a leaf spring 478 secured to both housings by cap screws 480 and 482.

Regardless of the diameter of the workpiece on which relieved threads are being produced, the number of times per revolution and rate at which the workpiece and housing is pivotly advanced and retracted with respect to the grinding wheel is dependent upon the number of flutes in the workpiece. Therefore, in accordance with a further feature of this invention, regardless of the diameter of the workpiece, only one cam 484, 486, or 488 (FIG. 15) is utilized for two, three, or four flute workpieces respectively to provide the required movement of the workpiece for grinding relieved threads. These cams have two, three, or four segments respectively, each with a contour producing a rise and fall in accordance with the well-known modified trapezoidal acceleration-deceleration curve. The magnitude of the pivotal motion required for grinding relieved threads of different diameters varies and is adjusted and controlled by moving the pivot point of a bellcrank assembly 490 actuated by the appropriate cam for two, three, or four flute workpieces. Cams 484, 486, and 488 can be selectively positioned one at a time in operative relationship with bellcrank assembly 490 which translates the motion produced by the cam into pivotal movement of the workpiece housing 322 with respect to the grinding wheel.

BELLCRANK ASSEMBLY

As shown in FIG. 17, bellcrank assembly 490 has a lever 492 with a roller follower 494 mounted by a pin 496 adjacent one end, and a pocket 498 adjacent the other end receiving a plunger pin 500. Pin 500 is slidably received in a bushing 502 with its other end bearing on an adjustable stop 504 threaded in workhead housing 322. Lever 492 has a pair of ears 506, the bottom faces of which bear on a pair of laterally spaced apart pivot pins 508 fixed to a slide member 510 which is slidably received in a groove 512 in a carrier plate 514 and retained therein by a plate 515. Carrier plate 514 is pivotally mounted in housing 324 by a leaf spring 516 secured by cap screws 517. Follower 494 is yieldably urged into engagement with one of the cams by a spring 518 received in a blind hole in carrier plate 514 and bearing on a cross plate 519 secured to lever 492.

The fulcrum or pivot point provided by pins 508 is moved to change the amplitude of the motion imparted to workhead housing 322, by an actuator mechanism 520 shown in FIGS. 19 and 20, which advances and retracts the slide 510 carrying the pivot pins. Actuator mechanism 520 has an arm 522 pivotally mounted on housing 324 by a cap screw 524 and a bearing assembly having a retainer plate 526, bushing 528, and bearing plate 530. The free end of arm 522 is slidably received in a slot in the end of slide 510 and is pivotally connected thereto by a pin 532. Arm 522 is rotated to extend or retract the slide 510 by a pair of shafts 534, each having a square drive on one end, a central portion threaded in a block 536 secured to housing 324, and the other end bearing on one of a pair of abutments 538 located on the opposite sides of the axis of rotation of the arm. To permit the bellcrank assembly 490 to be adjusted so that no pivotal movement of housing 322 is produced, the bottom of pocket 498 and the bottom faces of ears 506 lie in the same plane so that the points of contact of pivots 512 with the ears can be moved by actuator mechanism 520 so they are coincident with the point of contact of pin 500 with the bottom of pocket 498.

UNITED STATES AND EUROPEAN RELIEF CONVENTIONS

In accordance with another feature of this invention, relieved threads can be ground on the workpiece in accordance with either the United States or European conventions. Under the European convention, the relief of a thread begins immediately at its leading or cutting edge while under the United States convention, the initial portion of a thread is concentric and relief of the thread begins in back of or behind the leading or cutting edge of the thread.

Relieved threads may be produced in accordance with either convention by advancing or retracting both the bellcrank assembly 490 and the workhead housing 322 in unison with respect to the grinding wheel to control the point at which the workpiece begins to be moved eccentrically with respect to the grinding wheel by the relief mechanism. The bellcrank assembly and workhead housing can be raised or advanced in unison toward the grinding wheel sufficiently so that the point at which each thread segment begins to be relieved is behind its leading edge and, hence, the relief will be produced in accordance with the United States convention. However, if the bellcrank assembly and workhead housing are further raised or advanced in unison toward the grinding wheel, each thread segment will begin to be relieved at its leading edge in accordance with the European convention.

The bellcrank assembly and workhead housing are advanced and retracted in unison by a wedge assembly 540 shown in FIGS. 19 and 21. Assembly 540 has an actuator shaft 542 slidably received in a bore and counterbore in housing 324 with a free end which extends over carrier plate 514 and has secured thereto a wedge 544 which bears on an inclined ramp 546 on carrier plate 514. Wedge 544 is manually advanced and retracted by turning a drive shaft 548 having one end threaded into the actuator shaft, a central portion with an enlargement 550 journaled in and entrapped between a collar 552 and a cover plate 554 secured to a mounting plate 556 fixed to the end of housing 324, and a square drive tang on the other end.

RELIEF ENGAGING MECHANISM

The relief mechanism may be engaged and disengaged by respectively raising and lowering bellcrank assembly 490 to engage and disengage follower 494 with the overlying cam 484, 486, or 488. Bellcrank assembly 490 is pivotally raised against the bias of leaf spring 516 by a fluid actuated piston 558 (FIG. 17) slidably received in a cylinder formed by a collar 560 secured to housing 324 and having a plunger bearing on a lower face of carrier plate 514. Hydraulic fluid under pressure is supplied to the rear face of piston 558 through passages 562, and when the pressure is relieved, the piston is retracted by a spring washer 564.

CAM SELECTOR MECHANISM

As shown in FIG. 15, the relief cams can be shifted generally axially to overlie one at a time, the follower 494 of the bellcrank assembly 490 by manually moving axially a T-handle 568. Handle 568 is connected to one end of a shaft 570 slidably received in a bore through housing 324 with its other end fixed to one end of a drum 572, the other of which is rotatively connected by a screw 574 to a sleeve 576 in which the relief cams are journaled. Sleeve 576 is slidably received in a bore through a block 578 secured to housing 324. The relief cams are on a common shaft 580 journaled for rotation by ball bearings 582 which are retained by a collar 584 in the sleeve. Sleeve 576 is prevented from rotating in block 578 by a key 585 (FIG. 18) secured in a groove in the sleeve and projecting into a longitudinally extending groove in the block.

When the desired cam 484, 486, or 488 is positioned in operative relationship with bellcrank assembly 490, it can be releasably locked in such position by a retainer assembly 586. Retainer assembly 586 has a pin 588 fixed to drum 572 which pin can be selectively engaged in any one of three circular grooves 590, 592, and 594 spaced apart in a ring 596, a distance equal to the distance between the centers of the cams. Drum 572 is slidably and rotatively received in ring 596 which is secured by cap screws 597 to block 578. To permit drum 572 to be shifted axially, ring 596 also has a longitudinally extending groove 598 which intersects the circular grooves.

By manipulating handle 568, drum 572 can be rotated so that pin 588 is aligned with longitudinal groove 598 and then the handle and, hence, drum 572, sleeve 576, and the cams 484, 486, and 488 shifted axially to position the desired cam in operative relationship with the bellcrank assembly 490. The desired cam can then be locked in this position by rotating handle 568 and, hence, drum 572 to engage pin 588 in one of the circular grooves 590, 592, or 594 to thereby lock the cam in its operative position. As shown in FIG. 19, a spring biased detent 599 cooperates with three axially spaced conical pockets 600 in the drum 572 to releasably retain the pin 588 in simultaneous alignment with the longitudinal groove 588 and one of the circular grooves 590, 592, or 594. In cooperation with three axially spaced conical pockets 602 in the drum, detent 599 also releasably retains the pin 588 in one of the circular grooves when the drum is rotated to lock the desired cam in operative relationship with the bellcrank assembly.

CAM DRIVE AND STRAIGHT AND SPIRAL FLUTE OPTION

The cams are driven through a shaft 604 journaled for rotation in sleeve 452 by a thurst washer 606 and sleeve bearings 608 (FIGS. 23 and 24), having a spur gear 610 fixed on one end, and retained in the sleeve by a nut 612. To connect shaft 604 with the cams 484, 486, and 488, while permitting the cams to be shifted axially, the other end of shaft 604 is slidably received in a blind hole in cam shaft 580 (FIG. 15) and coupled thereto by a pair of keys 614 secured to shaft 604 and slidably received in longitudinally extending grooves in the cam shaft.

If the workpiece has straight flutes, each succeeding thread to be ground begins at the same angular location about the periphery of the workpiece, and, hence, the cams are rotated at the same speed as the workpiece. This is achieved by releasably locking gears 450 and 610 together with a cap screw 616 (FIGS. 15 and 23) so that shaft 604 and sleeve 452 through which the workpiece is driven, rotate together in unison.

However, if the workpiece has spiral flutes, each succeeding thread begins at a different angular location about the periphery of the workpiece and, hence, the cams must be rotated at a different speed relative to the workpiece. The cams must be rotated in timed relationship with, but at a slightly slower speed than, the workpiece so that the workpiece will be advanced and retracted with respect to the grinding wheel to begin grinding each succeeding thread at its correct angular location about the periphery of the workpiece. This is accomplished by removing cap screw 616 and inserting gear assembly 618 (FIGS. 22 and 24) to drive shaft 604 and, hence, the cams in timed relationship with the workpiece.

As shown in FIGS. 22 and 24, gear assembly 618 has a pair of spur gears 620 and 622 of differing pitch diameters meshing with gears 450 and 610 respectively and each keyed to an idler shaft 624, which is journaled by bearings 626 and 628 in a housing 630. As shown in FIG. 22, housing 630 is mounted by screw 632 on housing 438 so it can be pivotally moved to engage and disengage gears 620 and 622 with gears 450 and 610. Housing 630 can be releasably secured in such engaged and disengaged positions by a clamp screw 634 which extends through a slot 636 and threads into housing 438.

XI. TABLE AND LEAD SCREW ASSEMBLY

As shown in FIGS. 15 and 16, table 56 is mounted for reciprocation on sub-base 328 by a pair of roller bearings gib and way assemblies 638, each having one member secured to the sub-base by cap screws 640 and the other member secured to the table by cap screws 642. Table 56 is reciprocated to move a workpiece 32 generally axially with respect to grinding wheel 80 by a lead screw 644, journaled by ball bearings 646 on the table for axial movement therewith and threaded into a nut 648 secured to the sub-base 328. Ball bearings 646 and spacer sleeves 650 and 652 are received in a bore 654 in table 56 and retained therein by rings 656 and 658 secured to the table.

Any backlash between lead screw 644 and nut 648 is prevented from producing any inaccuracy in the grinding of threads on a workpiece 32 by an anti-backlash cylinder 660 with its piston rod 662 connected to table 56 and cylinder housing 664 secured to sub-base 328.

XII. LEAD SCREW DRIVE WITH METRIC-ENGLISH CONVERTER

Lead screw 644 is driven in timed relation with the rotation of workpiece 32 to produce threads on the workpiece of the desired true pitch in either the metric or English systems of measurement. To produce true metric threads, workhead drive gear 450 (FIG. 22) is selectively connected by drive and coupling gear assemblies 666 and 668 to a 127-tooth gear 670 (FIG. 15) keyed to one end of lead screw 644 for rotation therewith. To produce English fine threads, workhead drive gear 450 is selectively connected by drive and coupling gear assemblies 666 and 672 (FIG. 22) to a 120-tooth gear 674 keyed to lead screw 644 (FIG. 15) for rotation therewith. To produce English coarse threads, drive gear 450 is selectively connected by drive and coupling gear assemblies 676 and 678 to 120-tooth gear 674.

To permit coupling gear assemblies 668, 672, and 678 to be rotated about the axis of lead screw 644 so that each assembly can selectively engage its associated drive assembly 666 or 676, they are mounted on a ring 680 releasably secured to housing 436 by bolts 682 extending through arcuate slots 684 and threaded into the housing.

As shown in FIGS. 22 and 25, drive assembly 666 has a spur gear 686 which continuously meshes with drive gear 450 and is journaled for rotation by a bearing 688 mounted in housing 436 and a bearing 690 mounted in a carrier plate 692 secured by the cap screws 694 to the housing. Bearing 688 is retained in a pocket in housing 436 by a snap ring and spur gear 686 is secured to the inner race of the bearing by a stub shaft 696 secured to the gear by a cap screw 698 extending through a bushing 700 retained in the gear by a snap ring. Similarly, metric coupling assembly 668 has a spur gear 702 which continuously meshes with lead screw gear 670 and is journaled for rotation by a bearing 704 retained by a snap ring in a pocket in carrier ring 680 and a bearing 690 mounted in a plate 706 secured by cap screws 708 to the carrier ring. Gear 702 is secured to the inner race of bearing 704 by a stub shaft 705 secured to the gear by a cap screw 698 and a bushing 700 retained in the gear by a snap ring.

To produce metric threads, a pair of ratio spur gears 710 and 712 (FIG. 25) are mounted on drive assembly 666 and coupler assembly 668 and intermeshed by rotating carrier ring 680 clockwise from the position shown in FIG. 22. The pitch of the metric threads produced in the workpiece can be varied by utilizing pairs of gears 710 and 712 having differing ratios of their pitch diameters to each other. Ratio gears 710 and 712 are removably mounted on gears 686 and 702 respectively for rotation therewith by a pilot shank 714 with an enlarged head and cap screws 716.

As shown in FIG. 26, coupler assembly 672 for producing English fine threads has a spur gear 718 continuously meshed with gear 670 on the lead screw and journaled for rotation by a bearing 720 retained by a snap. ring in a pocket in carrier ring 680 and a bearing 722 mounted in plate 706. Gear 718 is secured to the inner race of bearing 720 by a cap screw 724 threaded into a retainer bushing 726. When producing English fine threads, a pair of ratio gears 710 and 728 are mounted on drive assembly 660 and coupling assembly 672 respectively and intermeshed by rotating carrier ring 680 to essentially the position shown in FIG. 22. The pitch of the English fine threads produced on the workpiece is varied by using pairs of gears 710 and 728 having differing ratios of pitch circle diameters to each other. Gear 728 is removably mounted on gear 718 for rotation therewith by a pilot shank 714 with an enlarged head and cap screws 716 threaded into gear 718.

As shown in FIG. 27, drive assembly 676 has a spur gear 730 which continuously meshes with drive gear 450 and is journaled for rotation by a bearing 688 retained in a pocket in housing 436 by a snap ring and a bearing 690 mounted in a plate 732 secured to the housing by cap screws 734. Similarly, English coarse thread coupler assembly 678 has a spur gear 736 which continuously meshes with gear 674 on the lead screw and is journaled for rotation by a bearing 704 retained by a snap ring in a pocket in carrier ring 680 and a bearing 690 in cover plate 706 secured to the carrier ring. Spur gear 736 is secured to the inner race of bearing 694 by a stub shaft 705 secured to the gear by a cap screw 698 extending through a bushing 700 retained in the gear by a snap ring.

When producing English coarse threads, a pair of ratio gears 740 and 742 are mounted on drive and coupler assemblies 676 and 678 respectively and are intermeshed by rotating carrier ring 680 counterclockwise from its position as shown in FIG. 22. The pitch of the English coarse thread may be varied by using pairs of gears 740 and 742 having differing ratios of their pitch diameters. Ratio gears 740 and 742 are removably mounted on gears 730 and 736 respectively by pilot shanks 714 and cap screws 716.

By selecting appropriate pairs of ratio gears, it is possible to produce a large variety of differing thread pitches on workpieces in either the metric or English systems of measurement with relatively few ratio gears 710, 712, 728, 740 and 742. For example, forty different and commonly used thread pitches can be produced by using only fifteen different gears 710, 712, 728, 740, and 742.

XIII. SET UP OF THREAD GRINDER

While a variety of different sequences can be used to set up machine 30 for grinding threads on a workpiece to produce a finished tap, it is usually preferable to first determine whether metric, English fine, or English coarse threads will be ground on the workpieces and then select the appropriate pair of ratio gears for producing the desired thread pitch. The selected ratio gears are installed on the appropriate drive assembly 666 or 676 and coupling assembly 668, 672, or 678 and carrier ring 680 is released, rotated, and resecured to intermesh the selected ratio gears. If the threads will not be relieved, piston 558 is de-energized through conventional electrohydraulic circuitry (not shown) to render the relief mechanism inoperative.

If the threads will be relieved, the appropriate relief cam 484, 486, or 488 is selected depending on whether the workpiece has two, three or four flutes. The selected cam is positioned and releasably retained for engagement with bellcrank assembly 490 by manually manipulating T-handle 568. Bellcrank assembly 490 is engaged with the selective cam by actuating piston 558. If the workpieces have straight flutes, gears 450 and 610 are fastened together to rotate in unison by inserting cap screw 616. However, if the workpieces have spiral flutes, cap screw 616 is removed and spiral gear assembly 618 activated by releasing, pivoting, and resecuring the assembly to mesh its gears 620 and 622 with gears 450 and 610 respectively. Gears 620 and 622 of assembly 618 are selected to provide in cooperation with gears 450 and 610 the proper ratio of rotation of the cam with respect to rotation of the work piece for the particular incline of the spiral of the flutes.

The rapid feed of grinding wheel 80 is advanced by energizing piston 180 through appropriate electrohydraulic circuitry (not shown). This also energizes piston rod 212 to eliminate any backlash in the feed screw 92 which controls feeding of the grinding wheel.

Workpiece center 334 is retracted, a workpiece 32 either manually or automatically inserted between workpiece centers 334 and 402, and center 334 is advanced to retain the workpiece between the centers. Center 334 is automatically retracted by admitting hydraulic fluid under pressure through passages 390 and 392 to act on piston face 396 through appropriate electrohydraulic circuitry (not shown) and is extended by the bias of spring 376 when such pressure is relieved. The advanced position of center 334 may be varied so that workpieces of differing lengths may be retained between the centers and is initially adjusted by manually turning knob 334.

The dial programmer 46 is most easily set up to produce finished threads having the desired pitch diameter by actuating cylinder 122 through electrohydraulic circuitry (not shown) to rotate dial 146 to the finish pass position wherein fixed dog 151 on the dial bears on positive stop 152. With motor 86 energized to rotate the grinding wheel 80, it is advanced by manually rotating wheel 112 of hand feed mechanism 110 until the grinding wheel just contacts or "sparks" the workpiece. Thereafter, piston 180 is de-energized to rapidly retract the grinding wheel and then wheel 112 is manually rotated to further advance the grinding wheel a distance equal to that required to produce the desired pitch diameter of the threads in the finished workpiece. Then the dial 146 of programmer 140 is rotated counterclockwise to its initial starting position (shown in FIG. 7) by energizing cylinder 122.

In accordance with the number of rough grinding passes required for the workpieces and the depth of each pass, one or more of dogs 140, 142, etc. is positioned on and secured to the dial 146 of the programmer. Typically, the infeed for a rough grinding pass is about 0.020 to 0.050 of an inch. Thus, small diameter workpieces often require only one rough grinding pass and, hence, use of one dog 140. Larger diameter workpieces require two or three rough grinding passes and, hence, use of two dogs 140 and 142, or three dogs 140, 142 and 144. If more than three grinding passes are required, additional dogs can be positioned on and secured to the dial 146 of the programmer. Usually, the last rough grinding pass is set to produce threads having a pitch diameter which is only 0.002 to 0.005 of an inch larger than the desired pitch diameter of the completely ground workpiece which is produced by the finish pass or passes. If desired, through appropriate electrohydraulic circuitry (not shown), two or more finish passes of the grinding wheel can be provided.

The manual feed for dresser assembly 48 is set up in either the English or metric system. The housing 254 of the mechanism for manually controlling the infeed of dresser assembly 48 is released, shifted generally longitudinally, and resecured to frame 50 so that the desired scale 310 or 311 on the handwheel 250 will read directly in either the English or metric system the extent of the infeed of the dresser assembly. The dresser assembly is then adjusted for automatic operation. With the grinding wheel 80 fully advanced to the finish pass position, motor 224 is energized to rotate dresser wheel 220, the dresser wheel is automatically advanced a predetermined amount by energizing piston 288 through appropriate electrohydraulic circuitry (not shown), and then the dresser assembly 48 is further advanced by manually rotating wheel 250 until the dresser wheel 220 just contacts or sparks the grinding wheel 80.

Drive mechanism 290 automatically dresses the grinding wheel by advancing the feed screw 94 a predetermined distance. Drive mechanism 290 is adjusted by manually turning stop screw 304 so that the mechanism will infeed the grinding wheel a distance equal to the desired decrease in the radius of the wheel to be produced by automatic dressing of the wheel. Drive mechanism 290 is actuated by an electrohydraulic circuit (not shown) to automatically dress the grinding wheel.

A few sample workpieces are ground in machine 30 and their pitch diameter measured to determine if the dial programmer has been in fact set up to produce the desired pitch diameter. Often, these samples indicate that minor adjustments of the manual infeed should be made to produce the desired pitch. Sometimes, grinding these samples also shows that the number of rough grinding passes and/or the amount of infeed for each rough grinding pass should be changed to minimize the time required to produce a finished workpiece.

After these sample workpieces demonstrate that machine 30 is set up to produce finished taps of the desired pitch diameter, the grinding machine may be either manually or automatically operated to produce finished taps. A plurality of workpieces 32 are loaded into transfer mechanism 34, which, when cycled, inserts one workpiece at a time into grinding machine 30 and removes a finished workpiece from the grinding machine.

XIV. OPERATION OF THREAD GRINDER

Machine 30 may be cycled either manually or automatically by appropriate conventional control circuitry (not shown) to grind threads on workpieces 32. When automatic cycling of machine 30 is initiated, cylinder 76 is retracted through electrohydraulic circuitry to open access door 72 which trips limit switch 78 to initiate cycling of transfer mechanism 34. The walking beam of the transfer mechanism is extended into the machine to underlie the centers and any finished tap carried by the workhead 52. When the walking beam is extended to this position, it trips a limit switch (not shown) on transfer mechanism 34 which, through electrohydraulic circuitry, retracts center 334 by applying fluid pressure to the piston face 396, thereby releasing any finished tap which is then received by the walking beam. Through a pressure sensitive switch in the hydraulic feedline to piston 396 and appropriate electrohydraulic curcuitry, including a delay relay or other timer, the walking beam is then further advanced and raised to insert a workpiece 32 between the centers and then trip a limit switch (not shown) on the transfer mechanism which, through electrohydraulic circuitry, causes center 334 to be advanced to retain the workpiece by relieving the fluid pressure acting on piston 396.

Relieving the pressure of the fluid on piston 396 changes the state of the pressure sensitive switch which, through electrohydraulic circuitry, initiates lowering and retraction of the walking beam. When the walking beam becomes fully retracted, it trips a limit switch (not shown) on the transfer mechanism which, through electrohydraulic circuitry, energizes cylinder 76 to close access door 72.

Through electrohydraulic circuitry (not shown), closing workpiece access door 72 also actuates cylinder 122 to rotate dial 146 of programmer 140. Dial 146 and feed screw 92 of the programmer are rotated until dog 140 trips limit switch 138 which, through electrohydraulic circuitry, stops further movement of cylinder 122 and, hence, the infeeding of the grinding wheel by the dial programmer; actuates piston 180 to rapidly advance or infeed the grinding wheel; and starts motors 58 and 86 to drive the lead screw, relief mechanism if activated, and grinding wheel.

When lead screw 644 has been rotated sufficiently for the portion of the workpiece 32 on which threads are being ground to make one complete pass under the grinding wheel, limit switch 156 is tripped by a dog on table 56 and through electrohydraulic circuitry, relieves piston 180 to rapidly retract the grinding wheel, and reverses hydraulic motor 58 and, hence, the direction of rotation of lead screw 644 to return the table 56 and, thus, the workpiece 32 to its starting position. When the table 56 returns to its starting position, dog 780 trips limit switch 782 which, through electrohydraulic circuitry, turns off motor 58 to stop the return of table 56, and energizes cylinder 122 to further rotate the dial 146 of the programmer to again infeed the grinding wheel.

The dial programmer causes grinding machine 30 to make one rough grinding pass through the workpiece for each rough grinding dog 140, 142, 144, etc., mounted on the dial 146 of the programmer by each such dog successively tripping limit switch 138. After the last rough grinding pass is completed, cylinder 122 rotates the dial 146 of the programmer until fixed dog 151 engages positive stop 152 which simultaneously activates pressure responsive switch 154. Through electrohydraulic circuitry, actuation of switch 154 energizes piston 180 to rapidly advance the grinding wheel and energizes motor 224 to drive the dressing wheel 220. Through electrohydraulic circuitry containing a delay relay or other appropriate timer, the actuation of switch 154 also causes pistons 288 and 302 to be momentarily energized to automatically dress the grinding wheel and compensate for the dressing of the grinding wheel. Through another electrohydraulic circuit containing another delay relay or other appropriate timer, the actuation of switch 154 also reenergizes motor 58 to rotate the lead screw 644 and, hence, pass the workpiece under the grinding wheel to finish grind the threads and thus produce a completed tap from the workpiece.

When the finish grinding is completed, a dog on table 56 trips limit switch 156 which de-energizes piston 180 to rapidly retract the grinding wheel, and reverses motor 58 and, hence, the direction of rotation of the lead screw 644 to return the table 56 and completed tap to its starting position. When the table is returned to its starting position, it again trips limit switch 782 which stops motor 58 and, hence, the return of the table. The tripping of limit switch 782, in conjunction with the prior actuation of pressure switch 154, when the dial 146 of the programmer was rotated to the fully advanced position, causes, through electrohydraulic circuitry, cylinder 122 to be energized to return the dial 146 of the programmer to its starting position. When dial 146 of the programmer is returned to its starting position, rack 126 trips limit switch 160 which, through electrohydraulic circuitry, deenergizes cylinder 122, turns off motor 86 to stop the grinding wheel, and energizes cylinder 76 to open access workpiece door 72. When the access door becomes fully open, it trips limit switch 78 which actuates transfer mechanism 34 to remove the finished tap and insert another workpiece to begin another cycle of grinding machine 30.

What is claimed is:

1. A machine for grinding workpieces comprising a base, a wheelhead carried by said base and constructed and arranged to rotate a grinding wheel for grinding a workpiece, a workhead constructed and arranged to releasably receive and rotate a workpiece, a table carrying said workhead and carried by said base for reciprocating the workpiece generally longitudinally with respect to the grinding wheel, a lead screw carried by one of said base and said table, a nut threadily engaging said lead screw and nut for rotation therewith, a driven metric gear connected to said one of said lead screw and nut for rotation therewith, a driven English gear connected to said one of said lead screw and nut for rotation therewith, a drive disposed radially outwardly of said driven gears and in fixed circumferential and axial relationship with the axis of rotation of said driven gears, said first drive being constructed and arranged to releasably mount and journal for rotation a first gear driven in timed relationship with rotation of the workpiece carried by said workhead, a metric coupler disposed generally radially between said drive and said driven gears and constructed and arranged to be releasably secured in a range of circumferentially spaced positions about said metric driven gear, said metric coupler having a gear continuously meshed with said metric driven gear and being constructed and arranged to releasably mount and journal for rotation a second ratio gear to mesh with a first ratio gear received on said drive and to rotate in unison with said gear continuously meshed with said metric driven gear, and an English coupler disposed generally radially between said drive and said English driven gear and constructed and arranged to be releasably secured in a range of circumferentially spaced positions about said English driven gear, said English coupler having a gear continuously meshed with said English driven gear and being constructed and arranged to releasably mount and journal for rotation a second ratio gear to mesh with a first ratio gear received on said drive and to rotate in unison with said gear continuously meshed with said English driven gear, whereby a selected pair of a first and second ratio gears may be respectively mounted on said drive and on one of said couplers and said one coupler moved circumferentially to mesh such first and second ratio gears to thereby drive said table in a predetermined timed relationship with rotation of the workpiece to feed the workpiece generally longitudinally under the grinding wheel at the appropriate rate for the grinding wheel to produce on the workpiece a thread having a desired pitch.

2. The grinding machine of claim 1 wherein said metric driven gear has a number of teeth equal to 127 or a multiple thereof.

3. The grinding machine of claim 1 wherein said one of said lead screw and nut, said driven gears, said drives, and said couplers are all carried by said table for reciprocation therewith.

4. The grinding machine of claim 1 which also comprises a relief mechanism having a cam carried by said table and constructed and arranged to rotate in timed relation with rotation of the workpiece, a fulcrum carried by said table, a lever arm received on said fulcrum, a follower carried by said arm and engagable with said cam, said arm being operatively associated with said workhead and constructed and arranged to move the workpiece carried by said workhead generally radially with respect to the grinding wheel in response to rotary motion of said cam, said fulcrum being constructed and arranged to permit the point at which said arm pivots thereon to be shifted generally longitudinally of said arm, and an actuator constructed and arranged to move said fulcrum with respect to said arm to vary and adjust the extent to which the workpiece is moved generally radially toward and away from the grinding wheel by rotation of said cam.

5. The grinding machine of claim 1 which also comprises said wheelhead being carried by said base for reciprocation in a straight line path and constructed and arranged to drive the grinding wheel with its axis of rotation extending essentially transversely to said straight line path of reciprocation, and a programmer for feeding the grinding wheel toward the workpiece for making successively deeper material removal cuts along the same path through the workpiece, said programmer having a first element carried by said base, a second element operatively connected with said wheelhead for movement therewith, one of said elements having a threaded portion thereof engaging a mating portion of the other of said elements with said portions being constructed and arranged so that relative rotation of said elements in one direction advances the grinding wheel carried by said workhead toward the workpiece and relative rotation in the opposite direction retracts the grinding wheel away from the workpiece, a positive stop associated with one of said elements to limit the extent to which said one element can be rotated to feed the grinding wheel toward the workpiece, a dial associated with said one element for rotation in synchronization with said one element, a drive operably associated with said dial and said one element for rotating them in synchronization with each other and said one element in one direction to advance the grinding wheel toward the workpiece and in the opposite direction to retract the grinding wheel from the workpiece, at least one switch constructed and arranged to change states when actuated by at least one dog carried by said dial, a first dog carried by said dial and being positioned thereon to actuate one of said switches when said drive has rotated said one element to feed the grinding wheel toward the workpiece to the full extent permitted by said positive stop, and at least one second dog releasably carried by said dial with said second dogs being carried by said dial in angularly spaced apart relationship with each other and said first dog to successively actuate one of said switches as said drive rotates said one element to advance the grinding wheel toward the workpiece, and control means responsive to actuation of said switches and operatively associated with said drive to stop rotation of said one element and said dial in response to actuation of said switches by each of said dogs so that the number of increments in which the grinding wheel is advanced toward the workpiece is a function of the number of said dogs carried by said dial and the extent of the advancement of the grinding wheel towards the workpiece for each increment is a function of the angular spacing of said dogs on said dial.

6. The grinding machine of claim 5 which also comprises a second drive constructed and arranged to rotate said other element of said programmer without rotating said one element thereof, said second drive rotating said other element in one direction to advance the grinding wheel toward the workpiece and in the opposite direction to retract the grinding wheel from the workpiece.

7. The grinding machine of claim 5 which also comprises a grinding wheel dresser adapted to receive a dressing tool and constructed and arranged to advance the dressing tool into engagement with the grinding wheel and to retract and disengage the dressing tool from the grinding wheel, and a second drive constructed and arranged to rotate said second element of said programmer without said first element thereof to advance the grinding wheel toward the workpiece in an amount equal to the decrease in the radius of the grinding wheel produced by operation of said grinding wheel dresser to thereby compensate the infeed of the grinding wheel for dressing of the grinding wheel.

8. The grinding machine of claim 7 which also comprises a third drive constructed and arranged to rotate said other element of said programmer without rotating said one element thereof and independently of said programmer and said second drive, said third drive rotating said other element in one direction to advance the grinding wheel toward the workpiece and in the opposite direction to retract the grinding wheel from the workpiece.

9. The grinding machine of claim 4 wherein said relief mechanism comprises three cams on a common axis of rotation and each driven in timed relation with the rotation of the workpiece carried by said workhead, said cams having a cam track with a contour constructed and arranged for relieving, two, three, and four flute workpieces respectively, and the track of each cam being selectively engageable one at a time with said follower.

10. The grinding machine of claim 4 wherein said releif mechanism is also constructed and arranged so that the point at which said lever arm pivots on said fulcrum and the point at which said lever arm is operably associated with said workhead can be advanced and retracted generally radially with respect tothe grinding wheel, and an actuator constructed and arranged to advance and retract generally radially with respect to the grinding wheel and in unison said workhead, said point of operative association of said lever arm with said workhead, and said point at which said arm pivots on said fulcrum whereby the workpiece carried by said workhead can be releived in accordance with European or United States convention.

* * * * *